US008852837B2

(12) United States Patent
Okada et al.

(10) Patent No.: US 8,852,837 B2
(45) Date of Patent: Oct. 7, 2014

(54) TONER, METHOD FOR FORMING IMAGE, AND IMAGE FORMING APPARATUS

(75) Inventors: Hideki Okada, Shiojiri (JP); Tomotaka Mori, Suwa (JP); Tomohiro Aruga, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 397 days.

(21) Appl. No.: 12/757,577

(22) Filed: Apr. 9, 2010

(65) Prior Publication Data

US 2010/0261109 A1 Oct. 14, 2010

(30) Foreign Application Priority Data

Apr. 13, 2009 (JP) ..... 2009-096735

(51) Int. Cl.

| | |
|---|---|
| ***G03G 9/00*** | (2006.01) |
| ***G03G 15/08*** | (2006.01) |
| ***G03G 9/08*** | (2006.01) |
| ***G03G 9/097*** | (2006.01) |

(52) U.S. Cl.

CPC ..... *G03G 15/0818* (2013.01); *G03G 9/0819* (2013.01); *G03G 9/09708* (2013.01)

USPC ..... 430/108.7; 430/108.3

(58) Field of Classification Search

CPC ..... G03G 9/08; G03G 9/00; G03G 9/113; G03G 9/0926; G03G 9/0819

USPC ..... 430/108.3, 108.7; 399/27, 30

See application file for complete search history.

(56) References Cited

U.S. PATENT DOCUMENTS

| | | | | |
|---|---|---|---|---|
| 5,475,469 | A * | 12/1995 | Okada et al. | 399/27 |
| 5,607,806 | A | 3/1997 | Kanbayashi et al. | |
| 2005/0287457 | A1 * | 12/2005 | Miyakawa et al. | 430/108.3 |
| 2008/0233496 | A1 * | 9/2008 | Kotsugai et al. | 430/48 |
| 2009/0022507 | A1 * | 1/2009 | Abe et al. | 399/30 |

FOREIGN PATENT DOCUMENTS

| | | | |
|---|---|---|---|
| JP | 58-026029 | A | 2/1983 |
| JP | 63-100017 | A | 5/1988 |
| JP | 03-191363 | A | 8/1991 |
| JP | 03-240068 | | 10/1991 |
| JP | 03-240068 | A | 10/1991 |
| JP | 08-184988 | A | 7/1996 |
| JP | 09-114135 | A | 5/1997 |
| JP | 2000-131873 | | 5/2000 |
| JP | 2002-253953 | A | 9/2002 |
| JP | 2003-122051 | A | 4/2003 |
| JP | 2003-280248 | | 10/2003 |
| JP | 2007017654 | A * | 1/2007 |
| JP | 2007-147979 | | 6/2007 |
| JP | 2009-015251 | | 1/2009 |
| JP | 2009-015259 | | 1/2009 |

OTHER PUBLICATIONS

English abstract of JP 2007017654 A, Jan. 2007, Japan, Handa et al.*

* cited by examiner

*Primary Examiner* — Mark F Huff
*Assistant Examiner* — Rashid Alam
(74) *Attorney, Agent, or Firm* — Workman Nydegger

(57) ABSTRACT

A toner includes toner base particles containing at least a binder resin, a coloring agent, and a release agent; and alumina fine particles whose phase angle (θ) is |80°| or less at an alternating current frequency of 1 to 10 kHz in an alternating current impedance method.

6 Claims, 10 Drawing Sheets

TM300

C805

STT30S

TONER, METHOD FOR FORMING IMAGE, AND IMAGE FORMING APPARATUS

BACKGROUND

1. Technical Field

The present invention relates to a toner, a method for forming an image, and an image forming apparatus.

2. Related Art

There have been image forming apparatuses that use a method including steps of rotatably mounting a photo-conductor such as a photosensitive drum or a photosensitive belt that is a latent image carrying unit onto a main body of an image forming apparatus, and during the image forming operation, forming an electrostatic latent image on a photosensitive layer of the photo-conductor, making the latent image visible in a contact or noncontact manner using toner, and directly transferring the visible image to a material to be transferred through corona transfer or using a transfer roller; or a method including steps of temporarily transferring the visible image to an intermediate transfer medium such as a transfer drum or a transfer belt and transferring the visible image to a material to be transferred again. In these image forming apparatuses, a two-component toner is publicly known, which can provide relatively stable development. However, the mixing ratio of a developer to a magnetic carrier easily varies, which requires the maintenance. On the other hand, a single-component magnetic toner cannot provide a clear color image because of the opacity of magnetic materials.

To obtain a high-quality recorded image while the above-described steps are repeated, toner needs to have a high flowability and be uniformly charged. In particular, when noncontact AC development is employed, from the viewpoint of improving flight behavior, the flowability of toner needs to be improved to decrease the adhesion of the toner to a developing roller. Furthermore, from the viewpoint of improving flight behavior under a development electric field, the frictional charge excessively accumulated in the toner needs to be discharged. Regarding a publicly known toner, silica fine particles are externally added thereto as a flow improver. However, since such silica fine particles have a high resistance of $10^{15}$ Ω·cm or higher, a charge-up phenomenon occurs when silica fine particles are charged. Consequently, the repetition of the image forming steps reduces image concentration.

Thus, it is attempted that alumina fine particles are externally added to toner base particles to produce a weak charge-leaking effect. With the charge-leaking effect, the triboelectrification of toner may be stabilized by discharging the frictional charge excessively accumulated in the toner and the flight behavior under a development electric field may be improved. Furthermore, with the polishing effect, the surface of a photo-conductor may be refreshed to stabilize the charge properties of the photo-conductor.

Nano-size alumina fine particles can be manufactured by (1) a low soda method (Showa Denko K.K. and Pacific Rundum Co., Ltd.), (2) a dawsonite method (TAIMEI CHEMICALS Co., Ltd. and HINOMOTO KENMAZAI Co., Ltd.), (3) a spark discharge method (Iwatani Chemical Industry Co., Ltd.), and (4) a flame hydrolysis method (NIPPON AEROSIL Co., Ltd.). Alumina fine particles have various forms such as α-alumina, γ-alumina, θ-alumina, and a mixed form thereof. For example, since α-alumina fine particles have a definite crystalline structure, an oxygen defect (lattice defect) that causes a charge-leaking effect is not easily formed, whereby triboelectrification is not sufficiently stabilized. Furthermore, α-alumina fine particles have a large particle size and a high hardness, which excessively produces a polishing effect. As a result, the excessively polished portions formed on the surface of a photo-conductor cause image defects, and α-alumina fine particles excessively scrape off the photo-conductor layer, which shortens the life of the photo-conductor.

There are proposed γ-alumina fine particles, alumina fine particles coated with silicone oil, and alumina fine particles subjected to surface treatment with a coupling agent (refer to JP:A-3-191363, JP-A-3-240068, and JP-A-8-184988). For γ-alumina that represents transition alumina, an oxygen defect (lattice defect) is easily formed depending on the manufacturing method and a large amount of water of constitution chemically adsorbed to an activated Al—OH group on the surface of the particles is contained, which easily produces a charge-leaking effect. However, it becomes difficult to control a decrease in frictional charge because of the excessive leaking effect and the environmental stability that depends on the water content in the air is degraded. Furthermore, the particle size of γ-alumina can be decreased, but γ-alumina easily forms secondary aggregates due to the activated Al—OH group on the surface of the particles. When γ-alumina is processed so as to adhere to the surface of toner base particles, an alumina free external additive that is present in a maldistribution state causes the following various problems.

Firstly, the leading edge of the triboelectrification characteristic curve decreases as a large number of sheets are printed. In particular, fogging after toner supply is caused in a toner supply type developing apparatus. For the toner in a developing apparatus, when developing operations are repeatedly performed many times, alumina fine particles as an external additive having a charge-leaking effect are gradually lost from the surface of the toner because the alumina fine particles become buried between toner base particles or liberated, which decreases the leading edge of the triboelectrification characteristic curve. (1) When the developing apparatus is a toner supply-type developing apparatus that can be resupplied with toner, a new toner to be used for development is supplied in addition to a residual toner. Alternatively, (2) when the developing apparatus is a single-use toner-type developing apparatus that cannot be resupplied with toner, a new toner is loaded so as to provide a recycled developing apparatus in addition to a residual toner. In either case, there is a difference in electrification capacity during triboelectrification between the new toner and the degraded toner that has been damaged in the developing apparatus. In single-component development, the difference in electrification capacity during triboelectrification between toner and a developing roller that is a toner carrying unit causes problems such as leakage of a toner layer during regulation, scattering of a toner layer on a developing roller at an upper seal, and fogging on a photo-conductor at a portion where an image is not formed, when an image is formed after a new toner is resupplied or loaded. In two-component development, the difference in electrification capacity between the new toner and the degraded toner during triboelectrification between the toner and the toner carrying unit causes problems such as scattering of a developer layer on a magnetic roller during regulation and fogging on a photo-conductor at a portion where an image is not formed.

The mechanism of this phenomenon is described below. Under the circumstances under which the degraded toner and the new toner are contained together in the developing apparatus, the new toner having a superior leading edge of the triboelectrification characteristic curve is formed on the lower side of the toner layer that is formed on a toner particle carrying roller (developing roller) and the degraded toner having an inferior leading edge of the triboelectrification characteristic curve is formed on the upper side of the toner layer so as to be separated from each other. Consequently, the degraded toner formed on the upper side and having inferior charge properties is easily detached from the toner carrying unit during the developing operation.

The toner particles are carried on the surface of the developing roller and pressed by a layer thickness regulating member, whereby the toner particles are rubbed by the surface subjected to a pressing force, the layer thickness regulating member, and the like and charged. The developing roller may have minute projections and depressions on a toner carrying surface by being subjected to sandblasting. However, the size, depth, shape, and arrangement of the depressions are nonuniform. Thus, toner particles that have entered deep depressions are sometimes not rolled and thus not appropriately charged. The nonuniformity of projections and depressions on the surface of the developing roller may locally cause poor electrification of the toner particles. If the toner particles become stuck in the minute depressions, filming may be caused. If the toner particles are not charged appropriately; the toner particles may leak out from the developing apparatus and be scattered in an image forming apparatus or fogging may occur on an image.

In recent years, there has been concern that dust is contained in a cooling airflow exhausted from electrophotographic image forming apparatuses to the outside, and the dust adversely affects the human body. An example of a standard that regulates dust in the air includes a standard regarding fine particulate matter (PM 2.5), which is reviewed by the Ministry of the Environment. In the near future, it is planned for legal guidelines to be disclosed as an environmental standard. It is expected that one of the causes of dust generation is that an external additive having charge-leaking properties is liberated from the surface of toner and emitted to the outside of the image forming apparatus during its operation. Furthermore, from the viewpoint of achieving clearness of an image, the particle size of toner has been decreased in recent years. It is believed that toner having a small volume-average particle size of about 5 μm becomes mainstream particularly in a color image forming apparatus. However, in the system in which an image is formed by applying an alternating current (AC) electric field between the developing roller and the photo-conductor, toner particles move onto the photo-conductor while reciprocate under a development electric field. Therefore, there is also concern that part of the toner activated in a cloud form under the development electric field rides an airflow that flows in the image forming apparatus, whereby the toner becomes dust.

Secondly, a phenomenon of photo-conductor memory is caused. The alumina fine particles as an external additive supposed to move onto the photo-conductor in synchronization with the toner during the developing operation partly move onto a transfer body in synchronization with the toner during the transferring operation, but part of the alumina fine particles in the free state is easily left on the photo-conductor without moving, onto the transfer body in synchronization with the toner. The alumina fine particles left on the photo-conductor are partly removed from the photo-conductor during the cleaning operation. However, a large amount of alumina fine particles remains left on the photo-conductor because the size is much smaller than that of the toner. The alumina fine particles left on the photo-conductor tend to gather at an edge portion of an image when an electrostatic latent image is formed. The alumina fine particles left without being removed in a cleaning step inhibit the operation such as uniform charging or writing exposure. The history (photo-conductor memory) of a change in surface potential becomes a one-step-earlier image forming history when an image is formed, which provides an afterimage.

For toner external-additive alumina fine particles, JP-A-3-191363 discloses a hydrophobic γ-phase alumina polishing material, but does not describe the solution for the above-described problem about charge properties caused by an alumina free external additive. JP-A-3-240068 discloses toner external-additive alumina fine particles manufactured using ammonium dawsonite and JP-A-8-184988 discloses toner external-additive alumina fine particles obtained by adopting amorphous alumina fine particles, both of which do not describe the solutions for the above-described problems.

SUMMARY

An advantage of some aspects of the invention is to provide a toner, a method for forming an image, and an image forming apparatus that can solve the problems regarding flight behavior, supply delay, leakage during regulation, scattering at an upper seal, fogging, leakage during regulation after toner supply, scattering at an upper seal after toner supply, and fogging after toner supply during development and that can suppress developing gap scattering and developing gap scattering after toner supply even if the toner is a small particle size toner to which alumina fine particles are externally added.

A toner according to a first aspect of the invention includes toner base particles containing at least a binder resin, a coloring agent, and a release agent; and alumina fine particles whose phase angle (θ) is |80°| or less at an alternating current frequency of 1 to 10 kHz in an alternating current impedance method.

It is preferable that the alumina fine particles are obtained by vaporizing aluminum using direct current arc plasma and then oxidizing the vapor or by pyrolyzing ammonium dawsonite.

It is preferable that the toner base particles have a volume-average particle size ($D_{50}$) of 2.0 to 12.0 μm and are obtained by phase inversion emulsification.

It is preferable that the alumina fine particles have a BET specific surface area of 30 to 250 $m^2/g$ and a number-average particle size of 5 to 80 nm.

A method for forming an image according to a second aspect of the invention includes preparing a photo-conductor that carries an electrostatic latent image and a developing apparatus facing the photo-conductor in a noncontact manner, the developing apparatus including a developing roller having a surface that carries a toner for developing the electrostatic latent image carried by the photo-conductor and a supplying roller configured to supply the toner to the developing roller; supplying the toner to the developing apparatus; and developing the electrostatic latent image carried by the photo-conductor under an alternating current electric field with an alternating current frequency of 1 to 10 kHz. In the method, the toner includes toner base particles containing at least a binder resin, a coloring agent, and a release agent and alumina fine particles whose phase angle (θ) is |80°| or less at an alternating current frequency of 1 to 10 kHz in an alternating current impedance method. The surface of the developing roller has a spiral groove formed with a constant pitch in an axis direction so as to be inclined with respect to the axis direction and a circumferential direction.

An image forming apparatus according to a third aspect of the invention includes a photo-conductor that carries an electrostatic latent image; and a developing apparatus facing the photo-conductor in a noncontact manner. The developing apparatus includes a developing roller having a surface that carries a toner for developing the electrostatic latent image carried by the photo-conductor and a supplying roller configured to supply the toner to the developing roller. The supplying roller faces the developing roller and is brought into contact with the developing roller with pressure. In the image forming apparatus, the toner includes toner base particles containing at least a binder resin, a coloring agent, and a release agent and alumina fine particles whose phase angle (θ) is |80°| or less at an alternating current frequency of 1 to 10 kHz in an alternating current impedance method. The surface of the developing roller has a spiral groove formed with a constant pitch in an axis direction so as to be inclined with respect to the axis direction and a circumferential direction. The electrostatic latent image carried by the photo-conductor is developed using the developing roller under an alternating current electric field.

In the developing apparatus used in the method for forming an image or the image forming apparatus, when the developing apparatus is a toner supply-type developing apparatus that can be resupplied with toner, development may be performed using a newly supplied toner in addition to a residual toner. When the developing apparatus is a single-use toner-type developing apparatus that cannot be resupplied with toner, development may be performed using a newly loaded toner in addition to a residual toner.

According to some aspects of the invention, there can be provided a toner, a method for forming an image, and an image forming apparatus that produces less dust and causes less developing gap scattering and fogging and also causes less developing gap scattering and fogging after toner supply.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
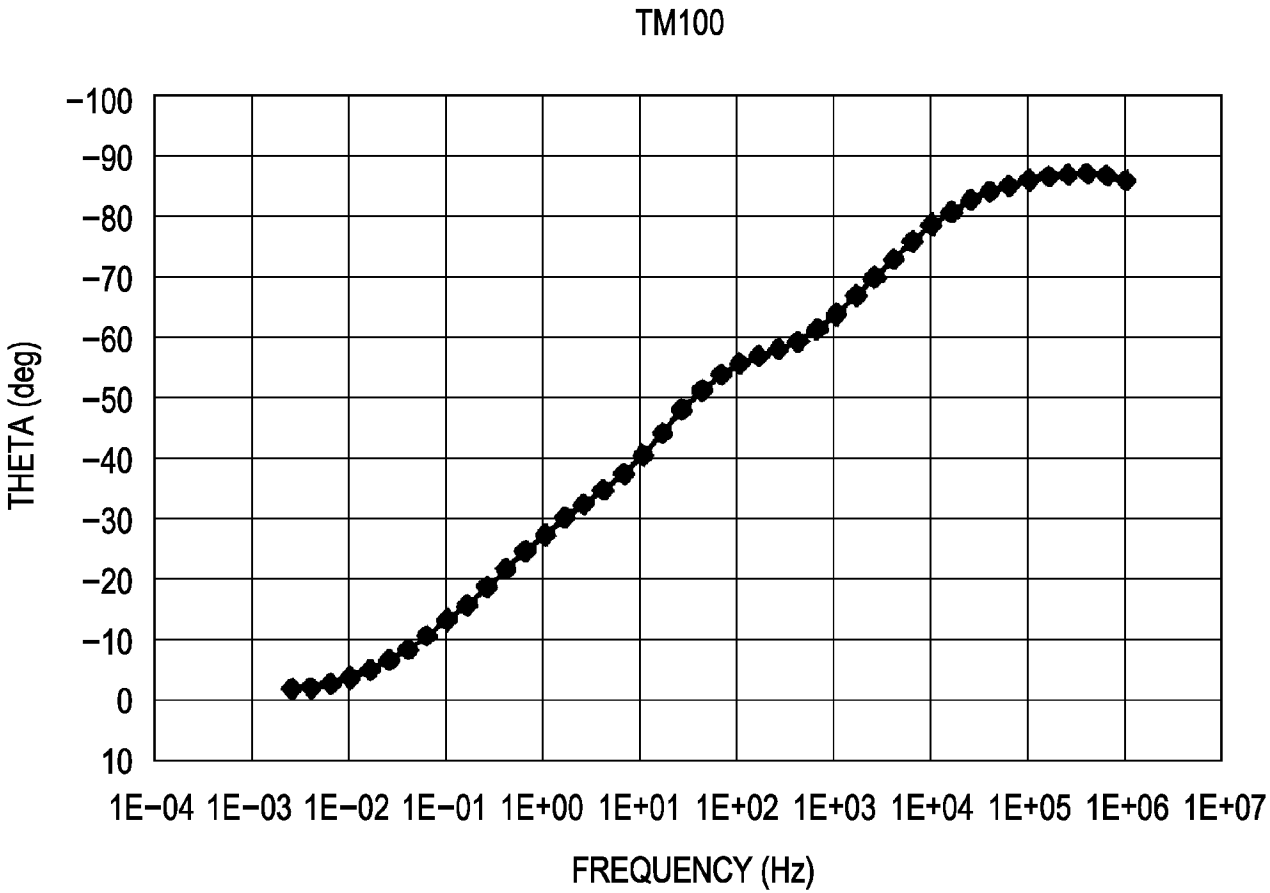
FIG. 1 shows the frequency-phase angle characteristic of alumina fine particles (Example 1) of the invention, the characteristic being measured by an alternating current impedance method.

Toner base particles of the invention contain at least a binder resin, a coloring agent, and a release agent. The toner base particles may be obtained by emulsion aggregation, but are preferably obtained by phase inversion emulsification. The toner base particles of the invention are manufactured through (1) a first step of forming fine particles by emulsifying a mixture containing at least a polyester resin and an organic solvent in an aqueous medium under the presence of a basic compound; (2) a second step of aggregating the fine particles by adding a dispersion stabilizer and then an electrolyte to make aggregates of the fine particles; and (3) a third step of removing the organic solvent contained in the aggregates, separating the aggregates of the fine particles from the aqueous medium, and cleaning and drying the aggregates.

The polyester resin is synthesized by dehydration condensation between a polybasic acid and a polyhydric alcohol. Examples of the polybasic acid include aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and alicyclic carboxylic acids such as cyclohexane dicarboxylic acid. These polybasic acids can be used alone or in combination. Among the polybasic acids, an aromatic carboxylic acid is preferably used.

Examples of the polyhydric alcohol include aliphatic diols such as ethylene glycol, diethylene glycol, triethylene glycol, propylene glycol, butanediol, hexanediol, neopentyl glycol, glycerin, trimethylol propane, and pentaerythritol; alicyclic diols such as cyclohexanediol, cyclohexanedimethanol, and hydrogenated bisphenol A; and aromatic diols such as an ethylene oxide adduct of bisphenol A and a propylene oxide adduct of bisphenol A. These polyhydric alcohols can be used alone or in combination. Among the polyhydric alcohols, an aromatic diol or an alicyclic diol is preferably used. An aromatic diol is more preferably used.

A terminal hydroxyl group and/or a terminal carboxyl group is esterified by adding a monocarboxylic acid and/or a monoalcohol to the polyester resin obtained by condensation polymerization between the polyvalent carboxylic acid and the polyhydric alcohol, whereby the acid value of the polyester resin can be adjusted. Examples of the monocarboxylic acid used for such a purpose include acetic acid, acetic anhydride, benzoic acid, trichloroacetic acid, trifluoroacetic acid, and propionic anhydride. Examples of the monoalcohol include methanol, ethanol, propanol, octanol, 2-ethylhexanol, trifluoroethanol, trichloroethanol, hexafluoroisopropanol, and phenol.

The polyester resin can be prepared by condensing the polyhydric alcohol and the polyvalent carboxylic acid on the basis of a common method. For example, an intended reactant can be obtained through the steps of adding the polyhydric alcohol and the polyvalent carboxylic acid to a reaction vessel equipped with a thermometer, a stirrer, and a falling condenser; heating the mixture at 150 to 250° C. under the presence of inert gas such as nitrogen; continuously removing low-molecular-weight compounds that are by-products to the outside of the reaction system; stopping the reaction when desired physical properties are achieved; and cooling the resultant product.

The polyester resin can be synthesized under the presence of a catalyst. Examples of an esterification catalyst used include organic metals such as dibutyltin dilaurate and dibutyltin oxide and metal alkoxides such as tetrabutyl titanate. When a lower alkyl ester is used as a carboxylic acid component, a transesterification catalyst can be used. Examples of the transesterification catalyst include metal acetates such as zinc acetate, lead acetate, and magnesium acetate; metal oxides such as zinc oxide and antimony oxide; and metal alkoxides such as tetrabutyl titanate. The additive amount of the catalyst is preferably 0.01 to 1% by mass relative to the total amount of raw materials.

In particular, to manufacture a branched or cross-linked polyester resin in such condensation polymerization, a polybasic acid having three or more carboxyl groups per molecule or an anhydride thereof and/or a polyhydric alcohol having three or more hydroxyl groups per molecule needs to be used as an indispensable synthetic material.

The polyester resin preferably has the following properties when measured with a constant-load extrusion type capillary rheometer (hereinafter, referred to as a "flow tester") in order that toner for use in a heat roller fixation system has a satisfactory fixing/offset temperature range without using an offset prevention liquid. That is, in measurement with the flow tester, the flow beginning temperature (Tfb) is in the range of 80 to 120° C., the T1/2 temperature is in the range of 100 to 160° C., and the flow ending temperature (Tend) is in the range of 110 to 210° C. The use of a polyester resin having such values measured with the flow tester results in good oilless fixing properties. Furthermore, the glass transition temperature (Tg) is preferably in the range of 40 to 75° C.

The flow beginning temperature Tfb, the T1/2 temperature, and the flow ending temperature Tend are determined with a flow tester (Model: CFT-500, available from Shimadzu Corporation). As shown in FIG. 1(*a*) disclosed in JP-A-2003-122051, the flow tester includes a cylinder 2 provided with a nozzle 1 having a diameter D of 1.0 mmΦ and a nozzle length (depth) L of 1.0 mm. A resin 3 (1.5 g) is charged into the cylinder 2. The stroke S of a loading surface 4 (displacement of the loading surface 4) is measured at a heating rate of 6° C./min while a load of 10 kg per unit area ($cm^2$) is applied to the loading surface 4 from the side opposite the nozzle 1, whereby the flow beginning temperature Tfb, the T1/2 temperature, and the flow ending temperature Tend are determined. That is, the relationship between the heating temperature and the stroke S is determined as shown in FIG. 1(*b*) disclosed in JP-A-2003-122051. When the resin 3 starts to flow from the nozzle 1, the stroke S steeply increases. The temperature at the leading edge of the curve is defined as Tfb. The temperature at the trailing edge of the curve after completion of the flow of the resin 3 from the nozzle 1 is defined as Tend. The temperature at the intermediate value S1/2 lying between the stroke Sfb at Tfb and the stroke Send at Tend is defined as T1/2 temperature. In the programmed temperature measurement using this apparatus, the test is performed at a constant heating rate with time. Thus, a process from a solid region to a flow region of a sample through a transition region and an elastomeric region can be continuously measured. With the apparatus, the rate of shear and viscosity in the flow region at any temperature can be easily measured.

The flow beginning temperature Tfb serves as an index of the sharp-melting property and the low-temperature fixing property of a polyester resin. An excessively high temperature degrades the low-temperature fixing property, which easily causes a cold offset. An excessively low temperature degrades storage stability, which easily causes a hot offset. Thus, the flow beginning temperature Tfb is preferably in the range of 85 to 115° C. and more preferably 85 to 110° C.

The melting temperature T1/2 of toner determined by a 1/2 method and the flow ending temperature Tend each serve as an index of anti-hot offset properties. In each case, an excessively high temperature increases the solution viscosity, which degrades the particle size distribution during the formation of particles. At an excessively low temperature, an offset easily occurs to degrade practicality. Thus, the melting temperature T1/2 in accordance with the 1/2 method needs to be in the range of 110 to 160° C. and preferably 110 to 150° C. The flow ending temperature Tend is preferably in the range of 110 to 200° C. and more preferably 110 to 180° C. When Tfb, T1/2, and Tend are set within the ranges, toner can be fixed in a wide temperature range.

The polyester resin contains a cross-linked polyester resin. The tetrahydrofuran-insoluble content of the binder resin is in the range of 0.1 to 20% by mass, preferably 0.2 to 10% by mass, and more preferably 0.2 to 6% by mass. The binder resin is preferably a polyester resin having a tetrahydrofuran-insoluble content of 0.1 to 20% by mass because good anti-hot offset properties are achieved. When the tetrahydrofuran-insoluble content is less than 0.1% by mass, the effect of improving the anti-hot offset properties is insufficient, which is not preferred. When the tetrahydrofuran-insoluble content is more than 20% by mass, the solution viscosity becomes excessively high, which increases the fixing initiation temperature. This disturbs fixing balance and thus is not preferred. Furthermore, this impairs the sharp-melting property to degrade transparency, color reproducibility, and gloss in a color image, which is not preferred.

The tetrahydrofuran-insoluble content of the binder resin is determined through the steps of weighing 1 g of the resin accurately; adding the resin to 40 ml of tetrahydrofuran to completely dissolve the resin; filtering the resulting mixture through 2 g of Radiolite (#700 available from Showa Chemical Industry Co., Ltd.) uniformly placed on Kiriyama filter paper (No. 3) in a filter funnel (diameter: 40 mm); placing the resulting cake on an aluminum dish; drying the cake at 140° C. for 1 hour; and weighing the resulting dry cake. The weight of the residual resin remaining in the dry cake is divided by the initial weight of the resin to express the resulting value in percentage. This value is defined as the tetrahydrofuran-insoluble content of the binder resin.

More preferably, the binder resin contains a high-viscosity cross-linked polyester resin and a low-viscosity branched or linear polyester resin. That is, in the polyester resin according to the invention, the binder resin may be composed of a single polyester resin. However, in general, the binder resin containing both a high-viscosity cross-linked polyester resin having a high molecular weight (cross-linked polyester resin) and a low-viscosity branched or linear polyester resin having a low molecular weight is practical and preferred in view of the production of the resin and in order to achieve a satisfactory fixing initiation temperature and satisfactory anti-hot offset properties. In the case where the binder resin contains both the cross-linked polyester resin and the branched or linear polyester resin, values of the binder resin measured using the flow tester need only to be within the above-described ranges. In the invention, the cross-linked polyester resin refers to a resin containing the tetrahydrofuran-insoluble component. The branched or linear polyester resin refers to a resin that is soluble in tetrahydrofuran and has no gel component determined through the measurement of the gel component.

In the invention, a plurality of polyester resins having different melt viscosities may be used as the binder resin. For example, in the case where a mixture of a low-viscosity branched or linear polyester resin and a high-viscosity cross-linked polyester resin is used, there is preferably used a mixture of a branched or linear polyester resin (A) and a cross-linked or branched polyester resin (B) that satisfy the following requirements. In this case, the melt viscosities and amounts of the resins (A) and (B) are appropriately adjusted such that values of the mixture measured using the flow tester are within the above-described ranges.

That is, the polyester resin (A) is a branched or linear polyester resin having a T1/2 temperature measured using the flow tester of 80° C. or more and less than 120° C. and a glass transition temperature Tg of 40 to 70° C. The polyester resin (B) is a cross-linked or branched polyester resin having a T1/2 temperature measured using the flow tester of 120° C. or more and 210° C. or less and a glass transition temperature Tg of 50 to 75° C. The ratio by weight of the polyester resin (A) to the polyester resin (B), i.e., (A)/(B), is in the range of 20/80 to 80/20. The T1/2 temperatures of the polyester resin (A) and the polyester resin (B) are defined as T1/2(A) and T1/2(B), respectively. The polyester resin (A) and the polyester resin (B) that satisfy the relationship 20° C.<T1/2(B)−T1/2(A) <100° C. are preferably used.

Regarding the temperature characteristics measured using the flow tester, the melting temperature T1/2(A) of the polyester resin (A) measured by the 1/2 method serves as an index for imparting the sharp-melting property and the low-temperature fixing property. The melting temperature T1/2(A) is more preferably in the range of 80 to 115° C. and particularly preferably 90 to 110° C.

The resin (A) specified in terms of these properties has a low softening temperature. In a fixing process using a heat roller, even when thermal energy is reduced because of a reduction in the temperature of the heat roller and an increase in process speed, the polyester resin (A) melts sufficiently and exhibits a satisfactory anti-cold offset property and a satisfactory low-temperature fixing property.

In the case where each of the melting temperature T1/2(B) measured by the 1/2 method and the flow ending temperature Tend(B) of the polyester resin (B) is excessively low, hot offset easily occurs. In the case where each of the melting temperature T1/2(B) and the flow ending temperature Tend (B) is excessively high, a particle size distribution during the formation of particles is degraded to reduce productivity. Consequently, T1/2(B) is more preferably in the range of 125 to 210° C. and particularly preferably 130 to 200° C.

The resin (B) specified in terms of these properties tends to be elastomeric and has high melt viscosity. The internal cohesive force of a melted toner layer is maintained during a heating and melting step in a fixing process. Thus, hot offset does not easily occur. After fixing, the polyester resin (B) is tough and thus exhibits satisfactory abrasion resistance.

A well-balanced mixing of the resin (A) and the resin (B) provides toner that sufficiently satisfies the anti-offset properties in a wide temperature range and the low-temperature fixing property. An excessively low ratio by weight of the resin (A) to the resin (B), i.e., (A)/(B), adversely affects the fixing property. An excessively high ratio adversely affects the anti-offset properties. Consequently, the ratio is preferably in the range of 20/80 to 80/20 and more preferably 30/70 to 70/30.

Melting temperatures of the resin (A) and the resin (B) measured by the 1/2 method are defined as T1/2(A) and T1/2(B), respectively. From the viewpoint of achieving a balance between the low-temperature fixing property and the anti-offset properties and in order to uniformly mixing the mixture without causing problems due to the difference in viscosity between the resins, T1/2(B)−T1/2(A) is more preferably more than 20° C. and 90° C. or less and particularly preferably more than 20° C. and 80° C. or less.

The glass transition temperature (Tg) is a value measured at a heating rate of 10° C. per minute by a second-run method using a differential scanning calorimeter (DSC-50) available from Shimadzu Corporation. When the polyester resin (A) has a Tg of less than 40° C. or when the polyester resin (B) has a Tg of less than 50° C., the resulting toner tends to cause blocking (a phenomenon in which toner particles are coagulated to form aggregates) during storage or in a developing apparatus, which is not preferred. On the other hand, when the polyester resin (A) has a Tg of more than 70° C. or when the polyester resin (B) has a Tg of more than 75° C., the fixing temperature of the toner increases, which is not preferred. When the polyester resin (A) and the polyester resin (B) that satisfy the above-described relationship and serve as the binder resin are used, the resulting toner has more satisfactory fixing properties, which is preferred.

To provide satisfactory fixing properties, the binder resin composed of the polyester resin preferably satisfies all of the following requirements: the weight-average molecular weight is 30,000 or more and preferably 37,000 or more; the (weight-average molecular weight (Mw))/(number-average molecular weight (Mn)) is 12 or more and preferably 15 or more; the area ratio of a component having a molecular weight of 600,000 to the total is 0.3% or more and preferably 0.5% or more; and the area ratio of a component having a molecular weight of 10,000 or less to the total is 20 to 80% and preferably 30 to 70%, in the measurement of the molecular weight by gel permeation chromatography (GPC) of the tetrahydrofuran-soluble fraction (THF-soluble fraction). In the case where the binder resin contains a plurality of resins, the GPC measurement result of a final resin mixture needs only to be within the above-described ranges.

In the polyester resin according to the invention, a high-molecular weight component having a molecular weight of 600,000 or more is effective in ensuring the anti-hot offset property. On the other hand, a low-molecular weight component having a molecular weight of 10,000 or less is effective in reducing the melt viscosity of the resin, thereby attaining the sharp melting property and reducing the fixing initiation temperature. Thus, the polyester resin preferably contains the resin component having a molecular weight of 10,000 or less. To obtain satisfactory thermal properties such as fixation at a low temperature, anti-hot offset properties, and transparency in an oilless fixing system, the binder resin preferably has such a broad molecular weight distribution.

The molecular weight of the THF-soluble fraction in the binder resin is determined in the following manner. That is, the THF-soluble fraction is filtered through a filter (0.2 μm) and then measured with a THF solvent (flow rate: 0.6 ml/min, temperature: 40° C.) using GPC•HLC-8120 produced by Tosoh Corporation and three columns "TSKgel Super HM-M" (15 cm) produced by Tosoh Corporation. Then, the molecular weight is calculated by means of a molecular weight calibration curve made using a monodispersed polystyrene standard sample.

The acid value (mg of KOH required to neutralize 1 g of a resin) of the polyester resin, is preferably within a range of 1 to 20 mg KOH/g for the following reasons: the above-described molecular weight distribution is easily obtained; ease of formation of fine particles by emulsification is readily ensured; and good environmental stability (stability of charge properties when the temperature and humidity change) of the resulting toner is easily retained. The acid value of the polyester resin can be adjusted by controlling a terminal carboxyl group of the polyester resin by means of the change in the mixing ratio and the reaction rate of the polybasic acid and the polyhydric alcohol as starting materials, as well as the addition of the monocarboxylic acid and/or the monoalcohol to the polyester resin obtained by condensation polymerization between the polyvalent carboxylic acid and the polyhydric alcohol, as described above. Alternatively, a polyester resin having a carboxyl group in the main chain thereof can be prepared using trimellitic anhydride as the polybasic acid component.

The toner base particles may contain a release agent. The release agent is selected from the group consisting of hydrocarbon waxes such as polypropylene wax, polyethylene wax, and Fischer-Tropsch wax; synthetic ester waxes; and natural ester waxes such as carnauba wax and rice wax. Among them, natural ester waxes such as carnauba wax and rice wax and synthetic ester waxes obtained from a polyhydric alcohol and a long-chain monocarboxylic acid are preferably used. An example of the synthetic ester wax suitably used is WEP-5 (available from NOF Corporation). When the content of the release agent is less than 1% by mass, the releasability is liable to be insufficient. When the content is more than 40% by mass, the wax is liable to be exposed on surfaces of the toner particles, which degrades the charge properties and storage stability. Therefore, the content of the release agent is preferably in the range of 1 to 40% by mass.

The toner base particles may contain a charge control agent. Examples of a negatively charged control agent include heavy-metal-containing acid dyes such as trimethylethane dye, metal complex salts of salicylic acid, metal complex salts of benzilic acid, copper phthalocyanine, perylene, quinacridone, azo dye, azo dye of metal complex salts, and azochromium complexes; calixarene type phenolic condensates; cyclic polysaccharide; and carboxyl- or sulfonyl-group-containing resins. The content of the charge control agent is preferably in the range of 0.01 to 10% by mass and particularly preferably 0.1 to 6% by mass.

The coloring agent is not particularly limited. Known coloring agents may be used, and in particular, a pigment is suitably used. Examples of black pigments include carbon black, cyanine black, aniline black, ferrite, and magnetite. Alternatively, coloring agents prepared from the following color pigments so as to develop a black color may be used.

Examples of yellow pigments include Chrome Yellow, Zinc Yellow, Cadmium Yellow, Yellow Ferric Oxide, ocher, Titanium Yellow, Naphthol Yellow S, Hansa Yellow 10G, Hansa Yellow 5G, Hansa Yellow G, Hansa Yellow GR, Hansa Yellow A, Hansa Yellow RN, Hansa Yellow R, Pigment Yellow L, Benzidine Yellow, Benzidine Yellow G, Benzidine Yellow GR, Permanent Yellow NCG, Vulcan Fast Yellow 5G, Vulcan Fast Yellow R, Quinoline Yellow Lake, Anthragen Yellow 6GL, Permanent Yellow FGL, Permanent Yellow H10G, Permanent Yellow HR, Anthrapyrimidine Yellow, Isoindolinone Yellow, Cromophthal Yellow, Novoperm Yellow H2G, Condensed Azo Yellow, Nickel Azo Yellow, and Copper Azomethine Yellow.

Examples of red pigments include Chrome Orange, Molybdenum Orange, Permanent Orange GTR, Pyrazolone Orange, Vulcan Orange, Indanthrene Brilliant Orange RK, Indanthrene Brilliant Orange GK, Benzidine Orange G, Permanent Red 4R, Permanent Red BL, Permanent Red F5RK, Lithol Red, Pyrazolone Red, Watching Red, Lake Red C, Lake Red D, Brilliant Carmine 6B, Brilliant Carmine 3B, Rhodamine Lake B, Alizarin Lake, Permanent Carmine FBB, Perinone Orange, Isoindolinone Orange, Anthanthrone Orange, Pyranthrone Orange, Quinacridone Red, Quinacridone Magenta, Quinacridone Scarlet, and Perylene Red.

Examples of blue pigments include Cobalt Blue, Cerulean Blue, Alkali Blue Lake, Peacock Blue Lake, Phanatone Blue 6G, Victoria Blue Lake, Metal-free Phthalocyanine Blue, Copper Phthalocyanine Blue, Fast Sky Blue, Indanthrene Blue RS, Indanthrene Blue BC, and Indigo.

The amount of the coloring agent used is preferably in the range of 1 to 50 parts by mass and particularly preferably 2 to 15 parts by mass relative to 100 parts by mass of the binder resin.

A method for manufacturing the toner base particles will now be described. In a first step, the polyester resin is added to an organic solvent and dissolved (by heating, if necessary) to prepare a mixture containing the polyester resin and the organic solvent. In this case, as a raw material for the toner, at least one selected from the coloring agents, the release agents, the charge control agents, and other additives may be used together with the polyester resin. In the invention, the coloring agent is preferably dispersed in the organic solvent together with the polyester resin. The additives such as the release agent and the charge control agent are also particularly preferably dissolved or dispersed in the organic solvent.

The following method is preferably employed as a method for dissolving or dispersing the polyester resin and, if necessary, the additives such as the coloring agent, the release agent, and the charge control agent in the organic solvent. A mixture containing the polyester resin and the additives such as the coloring agent, the release agent, and the charge control agent is kneaded at a temperature in the range of the softening temperature to the thermal decomposition temperature of the polyester resin using a pressure kneader, a heated twin roll, a twin-screw extruder, or the like. For example, the coloring agent may be melt-kneaded as a master batch. The resulting kneaded chips are then dissolved or dispersed in the organic solvent using a stirrer such as Despa. Alternatively, the polyester resin and the additives such as the coloring agent, the release agent, and the charge control agent are mixed with the organic solvent. The resulting mixture is wet-kneaded using a ball mill or the like. In this case, the coloring agent, the release agent, and the like may be separately preliminarily dispersed in advance.

More specifically, there is provided a method for manufacturing a resin solution containing the coloring agent, the release agent, and the like finely dispersed in the organic solvent by placing a resin solution containing the polyester resin dissolved in the organic solvent in advance, the coloring agent, and the release agent into a mixing/dispersing apparatus such as a ball mill, a bead mill, a sand mill, a continuous bead mill, or the like that uses grinding media; stirring and dispersing the mixture to form a master batch; and mixing the polyester resin for dilution and the additional organic solvent. In this case, a master batch prepared by kneading and dispersing the low-viscosity polyester resin and the additives such as the coloring agent and the release agent using a pressure kneader or a heated twin roll in advance is preferably used rather than the direct addition of the additives such as the coloring agent and the release agent to the mixing/dispersing apparatus such as a ball mill without any treatment. This manufacturing method is preferred because the polymeric component (gel component) of the polyester resin is not cleaved, compared with a dispersing method by melt-kneading.

Examples of the organic solvent for dissolving or dispersing the polyester resin and, if necessary, the coloring agent, the release agent, and the like include hydrocarbons such as pentane, hexane, heptane, benzene, toluene, xylene, cyclohexane, and petroleum ether; halogenated hydrocarbons such as methylene chloride, chloroform, dichloroethane, dichloroethylene, trichloroethane, trichloroethylene, and carbon tetrachloride; ketones such as acetone, methyl ethyl ketone, and methyl isobutyl ketone; and esters such as ethyl acetate and butyl acetate. These solvents may be used alone or in combination. In view of the recovery of the solvent, a single type of solvent is preferably used. The organic solvent that can dissolve the binder resin, has relatively low toxicity, and has a low boiling point so as to be easily removed in the subsequent step is preferred. Methyl ethyl ketone is most preferred.

In a method for emulsifying the mixture containing the polyester resin and the organic solvent with an aqueous medium, the mixture that contains the polyester resin, the organic solvent, and, if necessary, the coloring agent and the like and is prepared by the above-described method is preferably mixed and emulsified with the aqueous medium under the presence of a basic neutralizer. In this step, preferably, the aqueous medium (water or a liquid medium mainly composed of water) is gradually added to the mixture containing the polyester resin, the organic solvent, the coloring agent, and the like. In this case, gradual addition of water to the continuous organic phase of the mixture produces discontinuous water-in-oil phases. Further addition of water causes inversion of the discontinuous water-in-oil phases to produce discontinuous oil-in-water phases and forms a suspension or an emulsified liquid in which the mixture is suspended as particles (droplets) in the aqueous medium (hereinafter, this method is referred to as "phase inversion emulsification"). In phase inversion emulsification, water is added such that the ratio of the amount of water to the total amount of the organic solvent and water added is 30 to 70%, more preferably 35 to 65%, and particularly preferably 40 to 60%. The aqueous medium used is preferably water and more preferably deionized water.

The polyester resin is preferably an acidic group-containing polyester resin. The polyester resin is preferably a polyester resin converted into a self-water dispersible resin by neutralizing the acidic groups. The acid value of the self-water dispersible polyester resin is preferably in the range of 1 to 20 mg KOH/g. The acidic groups of the self-water dispersible resin are neutralized with a basic neutralizer to form anionic groups. This increases the hydrophilicity of the resin. The resulting resin (anionic self-water dispersible polyester resin) can be stably dispersed in an aqueous medium without a dispersion stabilizer or a surfactant. Examples of the acidic group include acidic groups such as a carboxyl group, a sulfonic acid group, and a phdsphoric acid group. Among them, a carboxyl group is preferred in view of charge properties of toner. Non-limiting examples of the basic compound used for neutralization include inorganic bases such as sodium hydroxide, potassium hydroxide, and ammonia; and organic bases such as diethylamine, triethylamine, and isopropylamine. Among them, the inorganic bases such as ammonia, sodium hydroxide, and potassium hydroxide are preferred. To disperse the polyester resin in an aqueous medium, there is a method in which a dispersion stabilizer such as a suspension stabilizer or a surfactant is added to the aqueous medium. However, the method for forming an emulsion by addition of the suspension stabilizer or the surfactant requires a high shearing force. Such an emulsion system is not preferred because of the formation of coarse particles and a broad particle size distribution. Therefore, preferably, the self-water dispersible resin is used, and the acidic groups of the resin are neutralized with the basic compound.

Examples of a method for neutralizing the acidic groups (carboxyl groups) of the polyester resin with the base include (1) a method including the steps of manufacturing a mixture of an acidic group-containing polyester resin, a coloring agent, a wax, and an organic solvent and then neutralizing the acidic groups with a base; and (2) a method including the steps of adding a basic neutralizer to an aqueous medium in advance and neutralizing the acidic groups of the polyester resin in the mixture during phase inversion emulsification. Methods of phase inversion emulsification include (A) an emulsifying method including a step of adding the mixture to an aqueous medium; and (B) an emulsifying method including a step of adding an aqueous medium to the mixture. A combination of the method (1) and the method (B) achieves a narrow particle size distribution, which is preferred.

In phase inversion emulsification, examples of high-shear emulsification apparatuses and continuous emulsification apparatuses that can be used include Homomixer (produced by Tokushu Kika Kogyo Co., Ltd.), Slasher (produced by Mitsui Mining Co., Ltd.), Cavitron (produced by Eurotec, Ltd.), Microfluidizer (produced by Mizuho Kogyo Co., Ltd.), Manton-Gaulin Homogenizer (produced by Gaulin Co.), Nanomizer (produced by Nanomizer Inc.), and Static Mixer (produced by Noritake Company). However, for example, a stirrer, an anchor blade, a turbine blade, a pfaudler blade, a full-zone blade, a max blend blade, a semicircular blade, or the like disclosed in JP-A-9-114135 is preferably used rather than the above-described high-shear emulsification apparatuses. Among them, a large blade such as the full-zone blade or the max blend blade capable of uniformly mixing a mixture is more preferred. In an emulsification step (phase inversion emulsification step) of forming fine particles of the mixture in an aqueous medium, the peripheral speed of the stirring blade is preferably in the range of 0.2 to 10 m/s. A method of adding water dropwise under low-shear stirring at a peripheral speed of 0.2 to less than 8 m/s is more preferred. Most preferably, the peripheral speed is in the range of 0.2 to 6 m/s. When the peripheral speed of the stirring blade is more than 10 m/s, the particle size in a dispersion formed during phase inversion emulsification is increased, which is not preferred. When the peripheral speed is less than 0.2 m/s, the stirring becomes nonuniform and nonuniform phase inversion is caused. As a result, coarse particles are readily formed, which is not preferred. The temperature during phase inversion emulsification is not particularly limited. Higher temperatures increase the number of coarse particles formed, which is not preferred. Excessively low temperatures increase the viscosity of the mixture containing the polyester resin and the organic solvent to increase the number of coarse particles formed, which is not preferred. The temperature during phase inversion emulsification is preferably in the range of 10 to 40° C. and more preferably 20 to 30° C.

Phase inversion emulsification is performed using the self-water dispersible resin under low shear, whereby the formation of a fine powder and coarse particles can be inhibited. Thus, in the subsequent coalescence step, aggregates of fine particles having a uniform particle size distribution are easily formed. In the case where a polyester resin not having self-water dispersibility is used or phase inversion emulsification is performed under high shear, the particle size distribution of the toner particles is broadened because of the formation of coarse particles and the formation of a fine powder composed of a low-molecular-weight component in the resin. Furthermore, the particles composed of the low-molecular-weight component are removed by screening in the subsequent step, which disadvantageously degrades the low-temperature fixing properties of the toner. The use of the self-water dispersible resin and the performance of phase inversion emulsification under low shear eliminate such problems.

The 50% volume-average particle size of the fine particles formed in the first step is preferably in the range of above 1 μm and 6 μm or less and more preferably above 1 μm and 4 μm or less. At a 50% volume-average particle size of 1 μm or less, in the case where the coloring agent and the release agent are used, they are insufficiently encapsulated in the polyester resin to adversely affect charge properties and development properties, which is not preferred. A large particle size limits the particle size of the resulting toner. Thus, the particle size of the fine particles formed in this step needs to be smaller than an intended particle size of the toner. A particle size of more than 6 μm is not preferred because coarse particles are easily formed. In the particle size distribution of the fine particles formed in the first step, the content of fine particles having a volume particle size of 10 μm or more is 2% or less and preferably 1% or less. The content of fine particles having a volume particle size of 5 μm or more is 10% or less and preferably 6% or less.

In a second step, the resulting fine particles obtained in the first step coalesce to form aggregates of the fine particles, and thus toner particles having a desired particle size are formed. In the second step, the amount of a solvent, temperature, the types and amounts of a dispersion stabilizer and an electrolyte, stirring conditions, and the like are appropriately controlled to obtain intended aggregates. There is widely known a method for manufacturing aggregates by forming fine particles by emulsion polymerization, coagulating the resulting fine particles, and fusing the coagulated particles by heating. Unlike the above-described method including two steps, the coagulating step and the fusing step, the manufacturing method (manufacturing method by coalescence) according to the invention includes a single step of simultaneously performing coagulation and fusion to form aggregates. In the method, spherical or substantially spherical particles can be obtained in a short time without heating.

In the second step, the resulting fine particle dispersion solution obtained in the first step is diluted with water to adjust the amount of the solvent. A dispersion stabilizer is then added thereto. An aqueous electrolyte solution is added dropwise thereto under the presence of the dispersion stabilizer to allow coalescence to proceed, whereby aggregates having a predetermined particle size are formed. The fine particles formed from the self-water dispersible resin in the first step are stably dispersed in an aqueous medium due to the effect of the electric double layer composed of a carboxylic acid salt. In the second step, the fine particles are destabilized by adding an electrolyte capable of destroying or reducing the electric double layer to the aqueous medium containing the fine particles dispersed therein.

Examples of the electrolyte include acidic materials such as hydrochloric acid, sulfuric acid, phosphoric acid, acetic acid, and oxalic acid. Furthermore, a water-soluble organic or inorganic salt such as sodium sulfate, ammonium sulfate, potassium sulfate, magnesium sulfate, sodium phosphate, sodium dihydrogenphosphate, sodium chloride, potassium chloride, ammonium chloride, calcium chloride, or sodium acetate may be effectively used. These electrolytes used for coalescence may be used alone or in combination. Among them, a sulfate of a monovalent cation such as sodium sulfate or ammonium sulfate is preferred in view of uniform coalescence. The resulting fine particles obtained in the first step are swollen with the solvent and become unstable because of the electric double layer shrunk by addition of the electrolyte. Therefore, even a collision of particles with each other even under low-shear stirring facilitates coalescence.

However, the addition of the electrolyte or the like alone results in nonuniform coalescence due to the unstable dispersion of the fine particles in the system, which produces coarse particles and aggregates. The aggregates of the fine particles formed by addition of the electrolyte and the acidic material may coalesce repeatedly to form aggregates each having a particle size of an intended particle size or more. To prevent this, an inorganic dispersion stabilizer such as hydroxyapatite or an ionic or nonionic surfactant needs to be added as a dispersion stabilizer before the addition of the electrolyte or the like. The dispersion stabilizer used needs to have a property to retain dispersion stability even under the presence of the electrolyte to be added. Examples of the dispersion stabilizer having such a property include nonionic emulsifiers such as polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, and Pluronic; anionic emulsifiers such as alkyl sulfates; and cationic dispersion stabilizers such as quaternary ammonium salts. Among them, an anionic or nonionic dispersion stabilizer is preferred because even a small amount of the dispersion stabilizer can stabilize the dispersion in the system. The clouding point of the nonionic surfactant is preferably 40° C. or more. These surfactants may be used alone or in combination. The addition of the electrolyte under the presence of the dispersion stabilizer (emulsifier) can prevent nonuniform coalescence. As a result, a narrow particle size distribution is obtained and thus the yield is improved.

Stirring conditions during coalescence are important to achieve uniform coalescence. For example, a stirrer, an anchor blade, a turbine blade, a pfaudler blade, a full-zone blade, a max blend blade, a cone cape blade, a helical blade, a double helical blade, or a semicircular blade disclosed in JP-A-9-114135 is appropriately selected and used. Among them, a large blade such as the full-zone blade or the max blend blade capable of uniformly mixing a mixture is more preferred. The fine particles swollen with the solvent collide with each other under stirring and coalesce to form aggregates. Thus, the use of a high-shear apparatus such as a Homomixer including a stator and a rotor or the use of a stirring blade such as a turbine blade that locally applies high shear and has a low ability to uniformly stir the entirety results in nonuniform coalescence, leading to the formation of coarse particles. Thus, in the stirring conditions, the peripheral speed is preferably in the range of 0.2 to 10 m/s, more preferably 0.2 to less than 8 m/s, and particularly preferably 0.2 to 6 m/s. When the peripheral speed is more than 10 m/s, nonuniform coalescence is caused and coarse particles are easily formed, which is not preferred. When the peripheral speed is less than 0.2 m/s, nonuniform coalescence due to the lack of a shear force for stirring is caused and coarse particles are easily formed, which is not preferred. Only the collision between the fine particles facilitates coalescence, and the resulting aggregates subjected to coalescence are not dissociated or dispersed again. Therefore, ultrafine particles are hardly formed and a narrow particle size distribution is achieved, which improves the yield.

In the second step, if necessary, the resulting fine-particle dispersion solution obtained by phase inversion emulsification in the first step is preferably further diluted with water. The dispersion stabilizer and the electrolyte are successively added thereto to perform coalescence. Alternatively, the solvent content of the dispersion solution is preferably adjusted by adding an aqueous solution of the dispersion stabilizer and/or the electrolyte to obtain particles each having an intended particle size. The solvent content in the system after the addition of the electrolyte is preferably in the range of 5 to 25% by mass, more preferably 5 to 20% by mass, and particularly preferably 5 to 18% by mass. When the solvent content is less than 5% by mass, the amount of the electrolyte required for coalescence increases, which is not preferred. When the solvent content is more than 25% by mass, the amount of aggregates increases due to nonuniform coalescence and the amount of the dispersion stabilizer added also increases, which is not preferred.

The shape of the toner particles after coalescence can be controlled by adjusting the solvent content. When the solvent content is in the range of 13 to 25% by mass, spherical to substantially spherical fine particles are easily formed by coalescence because of a large degree of swelling of the fine particles with the solvent. When the solvent content is in the range of 5 to 13% by mass, deformed to substantially spherical fine particles are easily formed because of a small degree of swelling of the fine particles with the solvent.

The content of the dispersion stabilizer used is preferably in the range of 0.5 to 3.0% by mass, more preferably 0.5 to 2.5% by mass, and particularly preferably 1.0 to 2.5% by mass relative to the solid content of the fine particles. At a dispersion stabilizer content of less than 0.5% by mass, the intended effect of preventing the formation of coarse particles is not produced. At a dispersion stabilizer content of more than 3.0% by mass, even when the electrolyte content is increased, coalescence does not proceed sufficiently. Thus, particles each having a predetermined particle size are not formed. As a result, the fine particles are left and thus the yield is decreased, which is not preferred.

The content of the electrolyte used is preferably in the range of 0.5 to 15% by mass, more preferably 1 to 12% by mass, and particularly preferably 1 to 10% by mass relative to the solid content of the fine particles. At an electrolyte content of less than 0.5% by mass, coalescence does not proceed sufficiently, which is not preferred. An electrolyte content of more than 15% by mass results in nonuniform coalescence and thus the yield is decreased due to the formation of aggregates and coarse particles, which is not preferred.

The temperature during coalescence is preferably in the range of 10 to 50° C., more preferably 20 to 40° C., and particularly preferably 20 to 35° C. At a temperature of less than 10° C., coalescence does not easily proceed, which is not preferred. At a temperature of more than 50° C., the rate of coalescence is increased and thus aggregates and coarse particles are easily formed, which is not preferred. Therefore, it is possible to form aggregates by coalescence at a low temperature of 20 to 40° C.

In the first and second steps, various embodiments can be made. Preferred embodiments are as follows: (1) a method in which in the first step, the fine particles are manufactured using the resin solution containing the polyester resin, the coloring agent, and, if necessary, the release agent and the charge control agent, and then the second step (coalescence step) is performed; (2) a method in which in the first step, the fine particles are manufactured using the resin solution containing the polyester resin, the coloring agent, and, if necessary, the release agent, the charge-control-agent dispersion solution is added thereto, and then the second step (coalescence step) is performed; (3) a method in which in the first step, the fine particles composed of the polyester resin are manufactured, at least one of the coloring-agent dispersion solution and, if necessary, the release-agent dispersion solution and the charge-control-agent dispersion solution is separately prepared, they are mixed, and then the second step (coalescence step) is performed; (4) a method in which in the first step, the fine particles are manufactured using the resin solution containing the polyester resin and the release agent, the coloring-agent dispersion solution and, if necessary, the charge-control-agent dispersion solution are added thereto, and then the second step (coalescence step) is performed.

These dispersion solutions such as the coloring-agent dispersion solution, the charge-control-agent dispersion solution, and the release-agent dispersion solution can be prepared as follows. For example, each of the agents is added to water together with a nonionic surfactant such as a polyoxyethylenealkyl phenyl ether, an anionic surfactant such as an alkyl benzene sulfonate or an alkyl sulfate, or a cationic surfactant such as a quaternary ammonium salt, and then the mixture is mechanically pulverized with grinding media to prepare a dispersion solution corresponding to one of the dispersion solutions. Alternatively, the dispersion solution can be prepared in the same manner as described above under the presence of the basic neutralizer using the self-water dispersible polyester resin instead of the surfactant. For the coloring agent, the release agent, and the charge control agent used herein, each of them may be melt-kneaded with the polyester resin in advance. In this case, since a resin adsorbs the materials, the degree of exposure of the materials on the surfaces of the particles is reduced and desirable properties are imparted in terms of charge properties and development properties.

To retain satisfactory triboelectrification properties, it is effective to prevent the coloring agent and the like from being exposed to the surfaces of the toner base particles, that is, it is effective to provide a toner structure in which the coloring agent and the like are encapsulated in the toner base particles. The degradation of charge properties due to a reduction in the particle size of the toner is also caused by the fact that the coloring agent and other additives (e.g., a wax) are partially exposed to the surfaces of the toner base particles. Even if the content (% by mass) of the coloring agent or the like is the same, the surface area of the toner base particles increases as the particle size decreases. Furthermore, the percentages of the coloring agent, wax, and the like exposed to the surfaces of the toner base particles are increased. As a result, the composition of the surfaces of the toner base particles markedly changes, and the triboelectrification properties of the toner base particles markedly change, which makes it difficult to obtain proper charge properties.

In the toner base particles, the coloring agent, the wax, and the like are preferably encapsulated in the binder resin. This encapsulated structure provides a satisfactory printed image. To actively encapsulate the coloring agent and the release agent in the binder resin, the above-described method (1) or (2) is preferably employed. It can be easily determined, for example, by observing the cross section of the particles using a transmission electron microscope (TEM) that the coloring agent and wax are not exposed to the surfaces of the toner base particles. Specifically, the toner base particles are embedded in a resin and cut using a microtome. The resulting cross section is optionally stained with ruthenium oxide or the like. TEM observation demonstrates that the coloring agent and wax are encapsulated in the binder resin and dispersed in the particles almost uniformly. Furthermore, the method (2) is preferred in order to localize the charge control agent on the surfaces of the toner particles to provide the function thereof.

The shape of the aggregates of the fine particles obtained in the second step can be changed from an irregular shape to a spherical shape in accordance with the degree of coalescence. For example, the average circularity can be changed between 0.94 and 0.99. The average circularity can be determined by taking a scanning electron microscope (SEM) photograph of the toner particles obtained by drying the aggregates of the fine particles and then by performing measurements and calculations. However, the average circularity is more easily determined using a flow type particle image analyzer FPIA 2100 produced by SYSMEX Corporation.

The toner particles are spherical or substantially spherical. The toner particles preferably have an average circularity of 0.97 or more, whereby powder flowability and transfer efficiency are improved. When the shape of the toner particles approaches from a spherical shape to an irregular shape, the particles have poor flowability in a stirrer described below during the external addition treatment. The yield is reduced even if the peripheral speed of the stirring blade is reduced. Furthermore, the amount of positively charged toner particles is increased, and thus a charge distribution is disadvantageously broadened. When the shape of the toner particles approaches to the spherical shape, it is difficult to uniformly attach the external-additive particles to the toner base particles. Thus, the peripheral speed of the stirring blade needs to increase. This causes adhesion to the tip of the blade and the wall of the tank, which reduces the yield. Furthermore, the amounts of free external-additive particles and positively charged toner particles are increased, which broadens the charge distribution.

In a third step, an organic solvent is removed from a slurry, that is, the dispersion solution of the aggregates of the fine particles obtained in the second step. The slurry is filtered through a wet vibration screen to remove foreign matter such as resin pieces and coarse particles. Solid-liquid separation can be performed by a known method using a centrifuge, a filter press, a belt filter, or the like. Subsequently, by drying the particles, toner base particles can be obtained. Preferably, the toner base particles manufactured using an emulsifier and a dispersion stabilizer are sufficiently cleaned.

Any publicly known method can be employed as a drying method. Examples of the drying method include a method for drying the toner base particles at a normal pressure or a reduced pressure at a temperature at which the toner base particles are not heat-sealed or coagulated; a method for freeze-drying the toner base particles; and a method for simultaneously separating the toner base particles from the aqueous medium and drying the toner base particles using a spray dryer. In particular, examples of the effective and preferable drying method include a method for drying the toner base particles under the mixing of powder at a reduced pressure at a temperature at which the toner base particles are not heat-sealed or coagulated; and a method for drying the toner base particles using a Flush Jet Dryer (produced by Seishin Enterprise Co., Ltd.) that instantly dries an object with a dry heated airflow.

For the particle size distribution of the toner base particles, the ratio of 50% volume particle size to 50% number particle size measured using Multisizer III available from Beckman Coulter, Inc. is preferably 1.25 or less and more preferably 1.20 or less. At a ratio of 1.25 or less, a satisfactory image is easily obtained, which is preferred. Furthermore, GSD is preferably 1.30 or less and more preferably 1.25 or less. The term "GSD" refers to a value determined from the square root of (16% volume particle size/84% volume particle size) measured by Multisizer III available from Beckman Coulter, Inc. A lower GSD value results in a narrower particle size distribution, which provides a satisfactory image.

The volume-average particle size of the toner base particles is preferably in the range of 2 to 12 μm in view of the resulting image quality and the like. In the case of color toner, the volume-average particle size is preferably in the range of about 3 to 8 μm. A smaller volume-average particle size improves definition and gradation and reduces the thickness of the toner layer for forming the printed image. Consequently, the effect of reducing the amount of the toner to be consumed per page is produced, which is preferable.

The synthesis example and physical properties of the polyester resin and the synthesis example of the toner base particles will now be described. The term "part" means a part by mass, and the term "water" means deionized water, unless otherwise specified.

Synthesis Example of Polyester Resin

In a separable flask, terephthalic acid (TPA) and isophthalic acid (IPA) as the divalent carboxylic acid, polyoxypropylene(2.4)-2,2-bis(4-hydroxyphenyl)propane (BPA-PO) and polyoxyethylene(2.4)-2,2-bis(4-hydroxyphenyl)propane (BPA-EO) as the aromatic diol, ethylene glycol (EG) as the aliphatic diol, and trimethylolpropane (TMP) as the aliphatic triol were placed at each molar ratio shown in Table 1, and 0.3% by mass of tetrabutyltitanate as the polymerization catalyst was placed thereto relative to the total amount of the monomers. The flask was equipped with a thermometer, a stirrer, a condenser, and a nitrogen introducing tube at the upper portion thereof. The mixture was subjected to reaction in an electric mantle heater at 220° C. for 15 hours in a nitrogen gas flow at normal pressure. After gradual evacuation, the reaction was continued at 10 mmHg. The reaction was monitored by measuring the softening point in accordance with the ASTM•E28-517 standard. The reaction was ended by terminating the evacuation when the softening point reached a predetermined temperature. Table 1 shows the composition and values of the physical properties (values of properties) of the thus-synthesized resin.

TABLE 1

| Resin | | | R1 | R2 |
|---|---|---|---|---|
| Resin composition | TPA | | 36.9 | 35.8 |
| | IPA | | 9.2 | 12.2 |
| | BPA-EO | | 11.3 | — |
| | BPA-PO | | 22.5 | 22 |
| | EG | | 20.1 | 27 |
| | TMP | | — | 3 |
| | Total | | 100 mol % | 100 mol % |
| Resin properties | Gel content (% by mass) | | 0 | 4 |
| | FT value | Tfb | 88 | 133 |
| | | T½ | 98 | 159 |
| | | Tend | 107 | 175 |
| | GPC | Mw | 5,600 | 78,000 |
| | | Mw/Mn | 2.7 | 25.8 |
| | | >600,000 | 0 | 3 |
| | | <10,000 | 100 | 42 |
| | DSC Tg (° C.) | | 55 | 65 |
| | Acid value KOH mg/g | | 6.7 | 10 |
| Type of resin | | | Linear | Cross-linked |

In Table 1,

>600,000: the area ratio of a component having a molecular weight of 600,000 or more.

<10,000: the area ratio of a component having a molecular weight of 10,000 or less TPA: terephthalic acid IPA: isophthalic acid BPA-PO: polyoxypropylene(2.4)-2,2-bis(4-hydroxyphenyl)propane BPA-EO: polyoxyethylene(2.4)-2,2-bis(4-hydroxyphenyl)propane EG: ethylene glycol TMP: trimethylolpropane FT value: a value measured by a flow tester In Table 1, the term "T1/2 temperature" means, as described above, a value measured using a flow tester (CFT-500 produced by Shimadzu Corporation) with a nozzle having a diameter of 1.0 mm and a length of 1.0 mm by applying a load of 10 kg per unit area ($cm^2$) at a heating speed of 6° C./min. The term "glass transition temperature Tg (° C.)" means a value measured at a heating rate of 10° C./min by the second-run method using a differential scanning calorimeter (DSC-50 produced by Shimadzu Corporation).

Preparation Example of Release-Agent Dispersion Solution

First, 50 parts of carnauba wax (Carnauba wax No. 1, product imported by Kato Yoko) and 50 parts of a polyester resin (R1 in Table 1) were kneaded using a pressure kneader. The kneaded mixture and 185 parts of methyl ethyl ketone were placed in a ball mill. After stirred for 6 hours, the mixture was taken out from the ball mill. The solid content was adjusted to 20% by mass to obtain a release-agent micro-dispersion solution (W1).

Preparation of Coloring-Agent Masterchip and Preparation Example of Coloring-Agent Dispersion Solution According to the composition shown in Table 2, a color pigment and a resin were kneaded in a ratio by weight of 50/50 to prepare a coloring-agent masterchip. The color pigment and the resin were kneaded using a twin roll. The resulting kneaded mixture and methyl ethyl ketone were placed in a ball mill such that the solid content was 40% by mass. After stirred for 36 hours, the mixture was taken out from the ball mill. The solid content was adjusted to 20% by mass to obtain a coloring-agent dispersion solution.

TABLE 2

| Coloring-agent masterchip | |
|---|---|
| Coloring agent | Cyan |
| Resin | R1 |
| Coloring agent/resin | 50/50 |

The coloring agent shown in Table 2 is described below.

Cyan pigment: Fastogen Blue TGR (produced by Dainippon Ink and Chemicals, Inc.)

Preparation of Wet-Kneaded Mill Base

The release-agent dispersion solution, the coloring-agent dispersion solution, the dilution resin (additional resin), and methyl ethyl ketone were mixed using Despa. The solid content was adjusted to 55% to obtain a mill base. Table 3 shows the composition of the mill base.

TABLE 3

| Coloring-agent masterchip (amount of resin) | Dilution resin (additional resin) | Wax dispersion solution (amount of resin) | Ratio of resin | Solid content |
|---|---|---|---|---|
| 30 parts (R1 3 parts) | R1/R2 = 28.8/55.2 (parts) | W1 50 parts (R1 5 parts) | R1/R2 = 40/60 | 55% |

Table 4 shows properties of the resin mixture shown in Table 3. The resin particles passing through 200 mesh were mixed at the above-described ratio by weight, and the properties were measured.

TABLE 4

| Properties of resin mixture | | R1/R2 40/60 |
|---|---|---|
| Resin properties | Gel content (% by mass) | 2.1 |

TABLE 4-continued

| Properties of resin mixture | | R1/R2 40/60 |
|---|---|---|
| FT value | Tfb | 112 |
| | T1/2 | 140 |
| | Tend | 154 |
| GPC | Mw | 52,000 |
| | Mw/Mn | 21.2 |
| | >600,000 | 2 |
| | <10,000 | 62 |
| DSC Tg (° C.) | | 58 |
| Acid value KOH mg/g | | 8.7 |

In Table 4,

>600,000: the area ratio of a component having a molecular weight of 600,000 or more.

<10,000: the area ratio of a component having a molecular weight of 10,000 or less Manufacturing of Toner Base Particles First, 545.5 parts of the mill base and 23.8 parts of 1N aqueous ammonia were placed in a 2 L cylindrical separable flask provided with a max blend blade as a stirring blade. The mixture was thoroughly stirred at 350 rpm using a Three-One Motor. Subsequently, 133 parts of deionized water was added thereto. The resulting mixture was further stirred and the temperature of the mixture was set to 30° C. Under the same conditions, 133 parts of deionized water was added dropwise to form a fine particle dispersion by phase inversion emulsification. In this case, the peripheral speed of the stirring blade was 1.19 m/s. Next, 333 parts of deionized water was added thereto to adjust the solvent content.

Subsequently, 4.1 parts of Epan 450 (produced by Dai-Ichi Kogyo Seiyaku Co., Ltd.) as a nonionic emulsifier was diluted with water and added to the fine particle dispersion. The temperature of the mixture was set to 30° C. The number of revolutions was set to 250 rpm. Next, 410 parts of 3% aqueous ammonium sulfate solution was added dropwise thereto to adjust the solvent content in the dispersion solution to 15.5% by mass. Under the same conditions, the stirring was continued for 70 minutes to complete coalescence. In this case, the peripheral speed was 0.85 m/s. Solid-liquid separation was performed on the resulting slurry using a centrifuge. The resulting solid was cleaned and then dried using a vacuum dryer to obtain toner base particles. Table 5 shows the properties of the toner base particles.

TABLE 5

| Initial dispersion diameter after phase inversion | | |
|---|---|---|
| Dv50 (μm) | Volume % of 10 μm or more | Volume % of 5 μm or more |
| 1.5 | 0.67 | 4.89 |

TABLE 6

| Toner particle properties | | | | |
|---|---|---|---|---|
| Dv50 (μm) | Dv50/Dn50 | GSD | Number % of 3 μm or less | Volume % of 10 μm or more |
| 4.0 | 1.07 | 1.17 | 9.9 | 0 |

TABLE 7

| Average circularity | Yield (%) |
|---|---|
| 0.982 | Pass |

The particle size and the particle size distribution shown in Table 6 were measured using Multisizer III available from Beckman Coulter, Inc. with a 100 μm aperture tube. The term "Dv50" means a 50% volume-average particle size. The term "Dv50/Dn50" means the ratio of the 50% volume-average particle size to the 50% number-average particle size. The term "GSD" means a value determined from the square root of (16% volume particle size/84% volume particle size).

The circularity distribution was measured using a flow type particle image analyzer FPIA 2100 produced by SYSMEX Corporation. The toner base particles preferably have a shape close to a spherical shape. Specifically, the toner base particles have an average circularity (R) of 0.95 to 0.99 and preferably 0.96 to 0.98, the average circularity being represented by the following formula:

$$R=L_0/L_1$$

where $L_1$ (μm) is a circumference of a projected image of a toner particle measured and $L_0$ μm) is a circumference of a perfect circle (geometrically perfect circle) having an area equal to a projected image of a toner particle measured. Thus, there can be provided toner that causes less variation in transfer efficiency during continuous printing and has a high transfer efficiency, a sufficient charge quantity, and ease of cleaning.

To obtain the yield, the solvent in the resulting dispersion solution of the toner base particles was removed and the mixture was passed through a 530-mesh screen. The yield was calculated using the following formula:

$$\text{Yield (\%)}=\{(\text{solid content of mill base fed})-(\text{solid content of residue on screen})\}\times 100/(\text{solid content of mill base fed})$$

where the toner base particles having a yield of 90 to 100% were expressed as "Pass".

Alumina fine particles of the invention will now be described. The alumina fine particles serve as an external additive, and the phase angle (θ) is the absolute value of 80° or less, that is, |80°| or less at an alternating current frequency of 1 to 10 kHz in an alternating current impedance method. Normally, conductivity is quantitatively measured using a voltammeter. However, when the powder of alumina fine particles or the like is used as a sample and the sample is measured by being sandwiched between electrodes, the resistant components are (1) a component derived from particle bulk, (2) a component derived from a contact interface (grain boundary) between particles, and (3) a component derived from the resistance at the interface between an electrode and a particle. If a direct current is used, these resistant components cannot be differentiated. Therefore, it is proposed that impedance of bulk resistance of particles be measured by an alternating current impedance method that uses an alternating current instead of a direct current. However, in the invention, a phase angle (θ) for each alternating current frequency measured by an alternating current impedance method is used as an index of charge leakage (conductivity) of alumina fine particles when an AC electric field is applied.

The alumina fine particles of the invention have a phase angle (θ) of |80°| or less at an alternating current frequency of 1 to 10 kHz in an alternating current impedance method. For example, when the phase angle (θ) exceeds −80° and approaches −90°, scattering from a developing gap and fogging occur as described in Comparative Examples 1 and 2 later, which is not preferred. It is believed that the shift of a phase angle (θ) by |90°| means the movement of charge in alumina fine particles cannot follow the change in the alternating current frequency. It is also believed that a phase angle (θ) of 0° means the movement of charge in alumina fine particles can follow the change in the alternating current frequency. The alumina fine particles need to have a phase angle (θ) of at least about |40°|, that is, −40 to −80° or +40 to +80° at an alternating current frequency of 1 to 10 kHz.

The alternating current frequency is specified in the range of 1 to 10 kHz because, in the alternating current component of a development electric field applied between a photoconductor and a developing roller, the frequency is preferably set to be high when the gap between the photo-conductor and the developing roller is small and the frequency is preferably set to be low when the gap is large. For example, in the case where toner particles having a small volume-average particle size of about 2 μm are used, preferably, a small gap is adopted and the alternating current frequency is set to be about 10 kHz. In the case where toner particles having a large volume-average particle size of about 12 μm is used, preferably, a large gap is adopted and the alternating current frequency is set to be about 1 kHz.

Alumina fine particles have been manufactured by one of various methods. For example, alumina fine particles having a phase angle (θ) of |80°| or less at an alternating current frequency of 1 to 10 kHz can be obtained by pyrolyzing ammonium dawsonite as disclosed in JP-A-63-100017, JP-A-58-26029, and JP-A-51-139810. Such alumina fine particles have an alumina purity of 99.99% or more, a BET specific surface area of 100 to 300 $m^2/g$, and a number-average particle size of 5 to 20 nm. Examples of commercially available alumina fine particles include TAIMICRON TM-100 ($Al_2O_3$) whose main phase is a θ-alumina phase and that has a primary particle size of 14 nm and a BET specific surface area of 132 $m^2/g$ (TAIMEI CHEMICALS Co., Ltd.) and TAIMICRON TM-300 ($Al_2O_3$) whose main phase is a γ-alumina phase and that has a primary particle size of 7 nm and a BET specific surface area of 225 $m^2/g$ (TAIMEI CHEMICALS Co., Ltd.).

Figure 2:
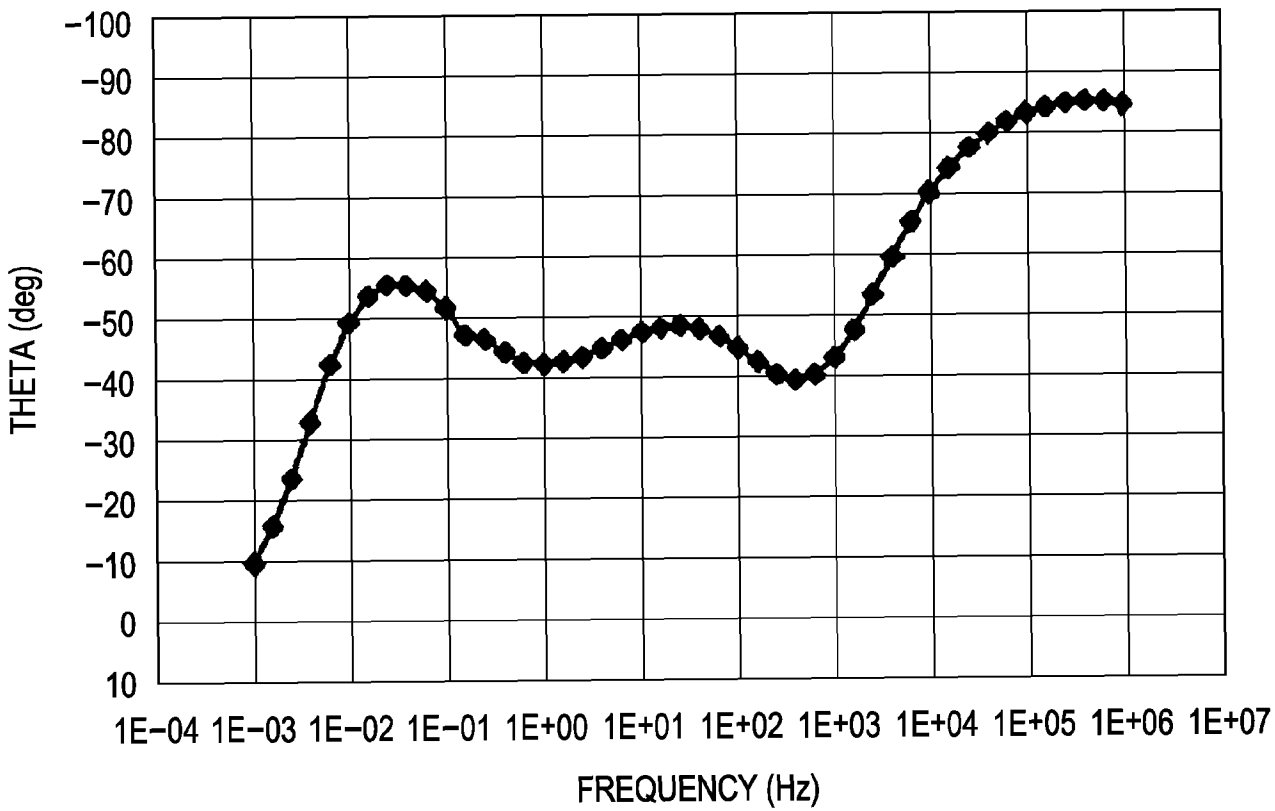
FIG. 2 shows the frequency-phase angle characteristic of alumina fine particles (Example 2) of the invention, the characteristic being measured by an alternating current impedance method.

FIG. 1 shows the frequency-phase angle characteristic of alumina fine particles (TAIMICRON TM-100) measured by an alternating current impedance method. In the drawing, "1E+03" of the frequency (Hz) on a transverse axis means $1\times10^3$ Hz (1 kHz) and "theta (deg)" on a vertical axis means θ (°). As is clear from FIG. 1, the phase angles are about |65°| at 1 kHz and |79°| at 10 kHz, which means the phase angle increases in a continuous manner. FIG. 2 shows the frequency-phase angle characteristic of alumina fine particles (TAIMICRON TM-300). As is clear from FIG. 2, the phase angles are about |43°| at 1 kHz and |70°| at 10 kHz, which means the phase angle increases in a continuous manner.

JP-A-2002-253953 discloses a method for manufacturing alumina fine particles. The alumina fine particles are manufactured by vaporizing aluminum using direct current arc plasma and then by oxidizing the vapor. The alumina fine particles have an alumina purity of 99.9% or more, a BET specific surface area of 20 to 80 $m^2/g$, and a number-average particle size of 20 to 100 nm. An example of the commercially available alumina fine particles includes Nano•Tek ($Al_2O_3$) that contains crystalline spherical fine particles having a γ-alumina phase as a main phase and a small amount of α-alumina phase and that has a primary particle size of 30 nm and a BET specific surface area of 49.3 $m^2/g$ (C. I. Kasei Company, Limited).

Figure 3:
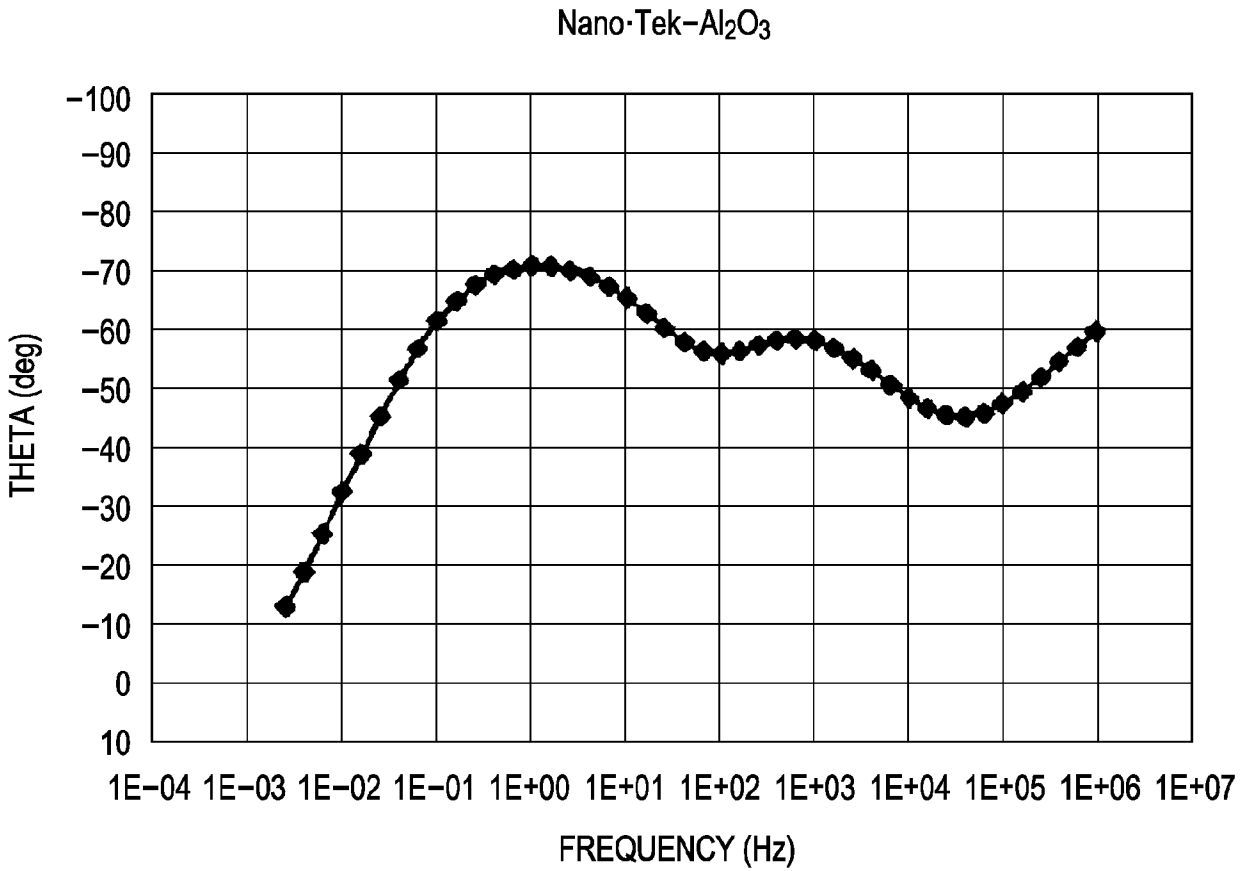
FIG. 3 shows the frequency-phase angle characteristic of alumina fine particles (Example 3) of the invention, the characteristic being measured by an alternating current impedance method.

FIG. 3 shows the frequency-phase angle characteristic of the commercially available alumina fine particles (Nano•Tek). As is clear from FIG. 3, the phase angles are about |58°| at 1 kHz and |48°| at 10 kHz, which means the phase angle decreases in a continuous manner from 1 to 10 kHz.

Figure 11:
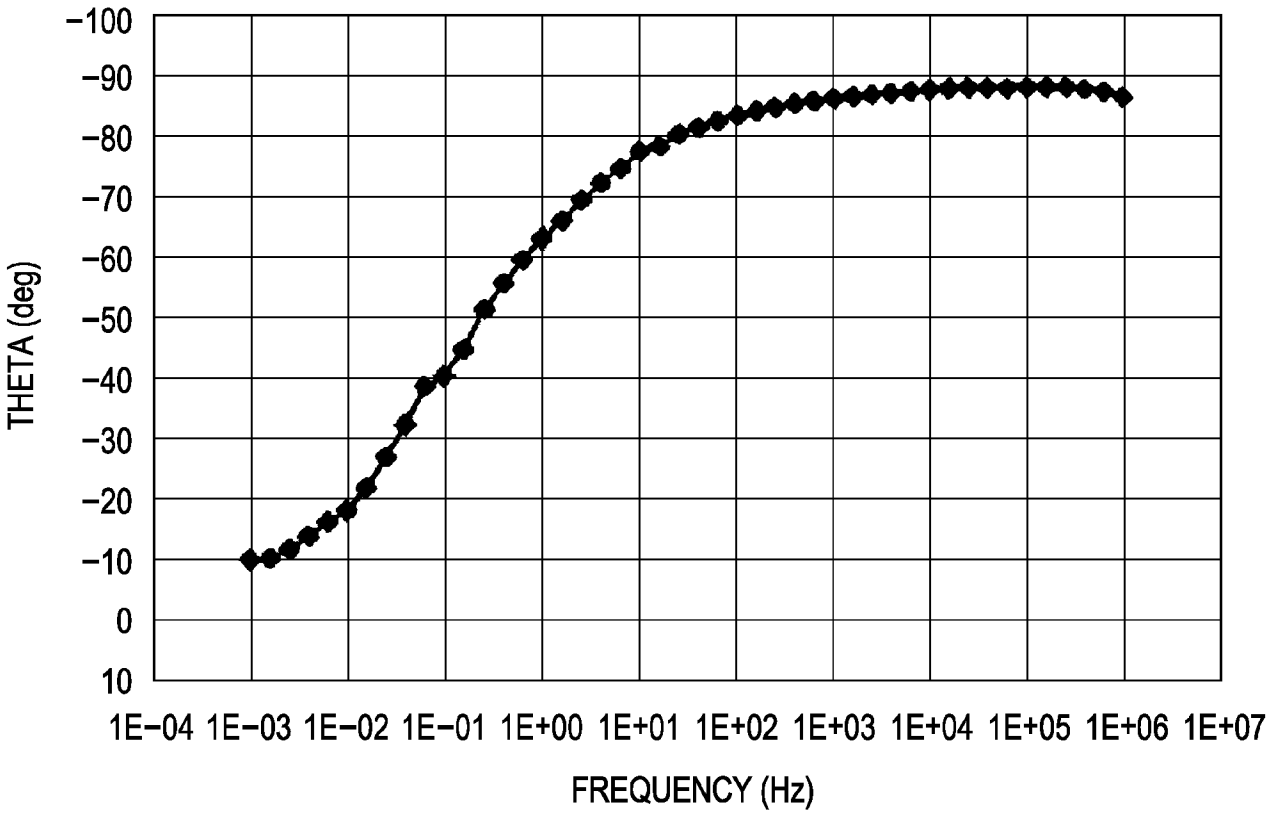
FIG. 11 shows the frequency-phase angle characteristic of alumina fine particles (Comparative Example 1) for comparison, the characteristic being measured by an alternating current impedance method.
Figure 12:
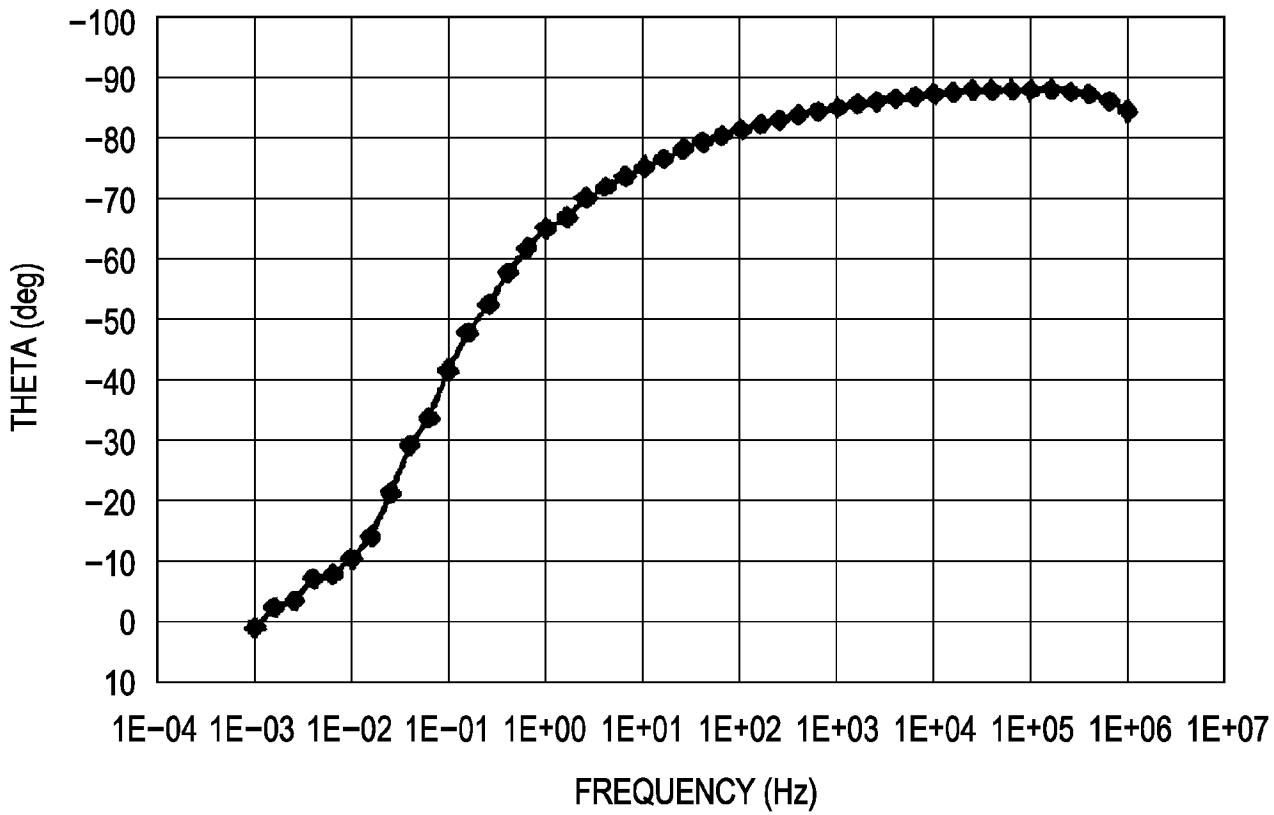
FIG. 12 shows the frequency-phase angle characteristic of titania fine particles (Comparative Example 2) for comparison, the characteristic being measured by an alternating current impedance method.

FIG. 11 shows the frequency-phase angle characteristic of alumina fine particles (C805 available from NIPPON AEROSIL Co., Ltd., particle size: 13 nm), which are generally regarded as conductive fine particles. As shown in FIG. 11, the phase angles are about |86°| at 1 kHz and |88°| at 10 kHz, which are angles close to 90°. FIG. 12 shows the frequency-phase angle characteristic of titania (STT30S available from Titan Kogyo, Ltd.) having a particle size of 20 to 50 nm and a BET specific surface area of 135 to 155 $m^2/g$. As shown in FIG. 12, the phase angles are about |85°|, at 1 kHz and about |88°| at 10 kHz, which are angles close to 90°.

The phase angle (θ) in an alternating current impedance method was measured using a dielectric measurement system (126096W available from Solartron in Britain) under the following conditions:

Sample holder for room-temperature solid: 12962A

Shape of sample: Tablet shape having a size of ϕ11 mm×1 mm (pressing pressure: 2 ton)

Sample is set in the sample holder while aluminum electrodes sandwich the sample from both sides thereof through conductive paste Applied voltage: 0.1 V Measured frequency: 1 mHz to 1 MHz The alumina fine particles according to the invention produce a charge-leaking effect under an AC electric field to stabilize the triboelectrification of toner. The alumina fine particles also produce a polishing effect that refreshes the surface of a photo-conductor to stabilize the charge properties of the photo-conductor. Furthermore, when a developing apparatus can be resupplied with toner, that is, a toner supply-type developing apparatus that uses newly supplied toner in addition to residual toner is used, fogging after toner supply and residual memory that occurs due to a free external additive left on the photo-conductor can be reduced. Alternatively, when a developing apparatus cannot be resupplied with toner, that is, a single-use toner-type developing apparatus that uses newly loaded toner in addition to residual toner is used, fogging after toner supply and residual memory that occurs due to a free external additive left on the photo-conductor can be reduced.

The alumina fine particles of the invention may be externally added to 100 parts by mass of toner base particles at an amount of 0.2 to 5.0 parts by mass and preferably 0.5 to 2.0 parts by mass. When the amount of the alumina fine particles externally added to the toner base particles is more than 5.0 parts by mass, a charge-leaking effect is excessively produced and a free external additive appears. When the amount is less than 0.2 parts by mass, a desired polishing effect is not achieved.

In Examples described later, alumina fine particles that are not hydrophobized were used. However, alumina fine particles may be hydrophobized with an organic silane compound such as alkylalkoxysilane, siloxane, silane, or silicone oil. In particular, alkylalkoxysilane is preferably used. Examples of the alkylalkoxysilane include vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane.

In addition to the alumina fine particles, hydrophobic small silica particles (1), hydrophobic monodispersed spherical large silica particles (2), or positively charged silica particles (3) may be used as the external additive for toner.

Examples of the hydrophobic small silica particles (1) having a number-average primary particle size of 7 to 16 nm and preferably 10 to 12 nm include R8200 available from NIPPON AEROSIL Co., Ltd. (bulk density: 0.1 to 0.2 $g/cm^3$, two-component charge quantity (5-minute value): −20 to −80 μC/g) and RX200 available from NIPPON AEROSIL Co., Ltd. (bulk density: 0.02 to 0.06 $g/cm^3$, two-component charge quantity (5-minute value): −100 to −300 μC/g). Both of them can be obtained by vapor phase oxidation (dry method) of silicon halide compounds and are different from each other in terms of the bulk density and two-component charge quantity (5-minute value).

In the hydrophobic small silica particles, the flowability of the toner obtained increases as the number-average primary particle size decreases. However, when the number-average primary particle size is less than 7 nm, the silica fine particles may be buried between toner base particles during external addition. In contrast, when the number-average primary particle size is more than 16 nm, the flowability may decrease. The hydrophobic small silica particles are added to 100 parts by mass of toner base particles at an amount of 0.5 to 3.0 parts by mass and preferably 1.0 to 2.0 parts by mass, whereby the hydrophobic small silica particles can provide low charge properties and high flowability to the toner base particles to suppress the formation of an agglomeration in a rubber thin layer regulating unit.

The bulk density is obtained by inserting powder into a 100 ml graduated cylinder using a funnel until the volume reaches 100 ml, measuring the weight, and substituting the weight into the following formula:

$$\text{Bulk density } (g/cm^3) = \{(\text{weight after sample is inserted}) - (\text{weight before sample is inserted})\} / \{\text{volume of graduated cylinder } (100 \text{ ml})\}$$

The hydrophobic monodispersed spherical large silica particles (2) have a number-average primary particle size of 50 to 250 nm and preferably 80 to 150 nm. The hydrophobic monodispersed spherical large silica particles have a spherical shape with a Wadell's sphericity of 0.6 or more and preferably 0.8 or more. The hydrophobic monodispersed spherical large silica particles are obtained by a sol-gel method that is a wet method, and the specific gravity is 1.3 to 2.1. When the number-average primary particle size is less than 50 nm, a spacer effect is not produced and the maintenance of the flowability and charge stability achieved by preventing silica fine particles with a small particle size from being buried onto the surface of toner base particles cannot be achieved. When the number-average primary particle size is more than 250 nm, the hydrophobic monodispersed spherical large silica particles are not easily attached to toner base particles and are easily detached from the surface of the toner base particles.

SEAHOSTAR KE-P10S2 available from NIPPON SHOKUBAI Co., Ltd. is exemplified as the hydrophobic monodispersed spherical large silica particles. SEAHOSTAR is amorphous (but may be partially crystalline) and is hydrophobized with silicone oil, and has a spherical shape, a number-average primary particle size of 100 nm, an absolute specific gravity of 2.2, a bulk density of 0.25 to 0.35, a BET specific surface area of 10 to 14 $m^2/g$, and a two-component charge quantity (5-minute value) of 0 to −50 μC/g.

The hydrophobic monodispersed spherical large silica particles are added to 100 parts by mass of toner base particles at an amount of 0.2 to 2.0 parts by mass and preferably 0.5 to 1.5 parts by mass. When the amount of the hydrophobic monodispersed spherical large silica particles added is less than 0.2 parts by mass, the packing density of toner increases. Consequently, when a toner layer is regulated to be thin using a regulating blade during the rotation of a developing roller, the toner layer is not easily thinned, which poses problems such as leakage during regulation and scattering. When the amount is more than 2.0 parts by mass, the packing density of toner excessively decreases. Consequently, when a toner layer passes through a regulating blade during the rotation of a developing roller, part of the toner leaks out without being held by the developing roller. Furthermore, because of the variation in the thickness of a toner layer formed that occurs in a developing roller cycle, the uniformity of the concentration in a direction of sheet feeding is impaired when a full page solid image is output, which poses a problem such as unevenness due to a developing roller cycle.

The addition ratio (by mass) of the large silica particles (2) to the small silica particles (1) is 1:4 to 4:1 and preferably 2:3 to 3:2. In that ratio, the flowability is imparted to toner and the long-term charge stability is achieved. The total amount of the large silica particles and the small silica particles is 1.25 to 5.0 parts by mass and preferably 2.0 to 3.0 parts by mass relative to 100 parts by mass of toner base particles while the addition ratio thereof is taken into account.

The silica fine particles are preferably hydrophobized. By hydrophobizing the surface of negatively charged silica fine particles, the flowability and charge properties of the toner are further improved. The silica fine particles can be hydrophobized by a wet or dry method normally employed by a person skilled in the art, using a silane compound such as hexamethyldisilazane or dimethyldichlorosilane; or a silicone oil such as dimethyl silicone, methyl phenyl silicone, a fluorine-modified silicone oil, an alkyl-modified silicone oil, or an epoxy-modified silicone oil.

Positively charged silica particles (3) have a number-average primary particle size of 20 to 40 nm. The positively charged silica fine particles are preferably hydrophobized, and added in order to decrease the variation in charge properties with respect to the change of an external environment, maintain stable charge properties, and improve the flowability of toner. The positively charged silica fine particles are hydrophobized with an aminosilane coupling agent, an amino-modified silicone oil, or the like. Examples of the hydrophobized positively charged silica fine particles include commercially available NA50H produced by NIPPON AEROSIL Co., Ltd. and TG820F produced by Cabot Corporation. NA50H is amorphous and is hydrophobized with hexamethyldisilazane and aminosilane, and has a spherical shape, a number-average primary particle size of 30 nm, an absolute specific gravity of 2.2, a bulk density of 0.0671, a BET specific surface area of 44.17 $m^2/g$, a carbon amount of 2% or less, and a two-component charge quantity (5-minute value) of 40 μC/g.

The average particle size of the external-additive fine particles is determined by observing the particles using a transmission electron microscope and measuring the particle sizes of 100 particles in a field of view.

The BET specific surface area is determined using an automatic surface area analyzer Macsorb HM model-1201 available from Mountech Co., Ltd.

The external additive may be added to toner base particles using a Henschel mixer (available from MITSUI MIIKE MACHINERY Co., Ltd.), a Q-type mixer (available from MITSUI MINING COMPANY, Limited), a Mechanofusion system (available from Hosokawa Micron Corporation), or a Mechanomill (available from OKADA SEIKO Co., Ltd.). When multistage processing is performed using a Henschel mixer, the operation conditions at each stage are selected from a peripheral speed of 30 to 50 m/s and a processing time of 2 to 15 minutes.

The multistage processing is desirably constituted by three stages of the additions of the external additives. At a first stage, alumina fine particles are processed to the toner base particles. At a second stage, the hydrophobic monodispersed spherical large silica particles and the hydrophobic small silica particles are processed and attached to the toner base particles. At a third stage, the positively charged silica fine particles are processed to the toner base particles. Thus, there can be provided a negatively charged single-component non-magnetic toner that can adjust the charge distribution when a toner layer is regulated to be thin and suppress the formation of an electrostatic agglomeration caused by a charge-up phenomenon.

In the invention, other hydrophobized external additives may be added as long as the purpose of the addition of the external-additive particles is not defeated. Examples of the other hydrophobized external additives include hydrophobic medium silica particles (fumed silica RX50 available from NIPPON AEROSIL Co., Ltd., absolute specific gravity: 2.2, volume-average particle size $D_{50}$: 40 nm (standard deviation=20 nm)); magnesium stearate, calcium stearate, zinc stearate, aluminum monostearate, and aluminum tristearate that are each a metal salt of a higher fatty acid which is a metallic soap particle, the metal being selected from magnesium, calcium, and aluminum; fine particles of metal oxides such as zinc oxide, strontium oxide, tin oxide, zirconium oxide, magnesium oxide, indium oxide, titanium oxide, and cerium oxide; fine particles of nitrides such as silicon nitride; fine particles of carbides such as silicon carbide; resin particles; fine particles of metal salts such as calcium sulfate, barium sulfate, calcium carbonate, and strontium titanate; and inorganic fine particles such as a complex of the foregoing.

In the toner of the invention, the flow softening temperature (Tf1/2) is in the range of 90 to 140° C. and the glass transition temperature (Tg) is in the range of 40 to 70° C. The flow softening temperature (Tf1/2) is determined with a flow tester (CFT-500 available from Shimadzu Corporation). The measurement is performed using a nozzle having a diameter of 1.0 mmΦ and a length of 1.0 mm at a heating rate of 6° C./min while a load of 10 kg per unit area ($cm^2$) is applied. The glass transition temperature (Tg) is determined at a heating rate of 10° C./min by a second-run method using a differential scanning calorimeter (DSC-220C available from Seiko Instruments Inc.).

Figure 4:
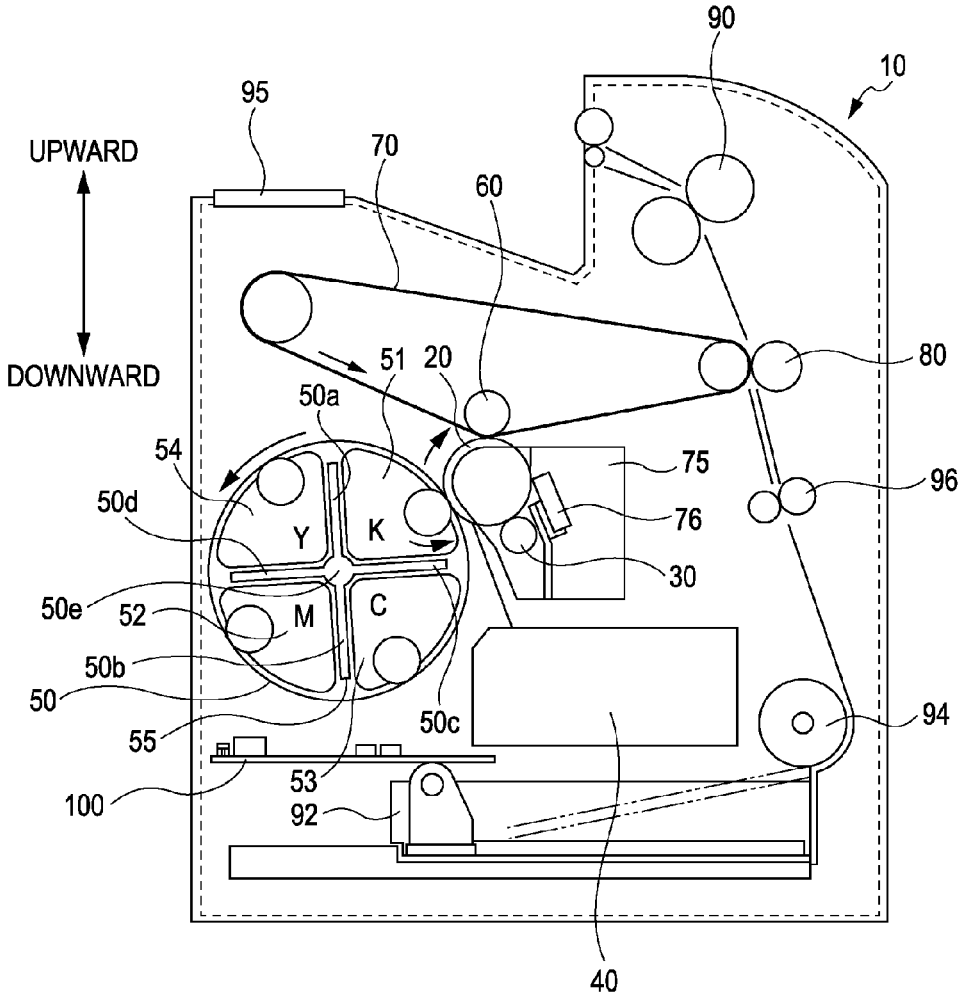
FIG. 4 is a schematic view for describing a general outline of an image forming apparatus of the invention.

A method for forming an image and an image forming apparatus of the invention will now be described. FIG. 4 is a diagram for describing a general outline of the image forming apparatus of the invention. In FIG. 4, a printer 10 includes a charging unit 30, an exposure unit 40, a developer container holder 50, a primary transfer unit 60, an intermediate transfer belt 70, and a cleaning unit 75 in the rotational direction of a photo-conductor 20. The printer 10 further includes a secondary transfer unit 80 and a fixing unit 90.

The photo-conductor 20 has a cylindrical conductive material and a photosensitive layer formed on the outer surface of the conductive material, and can rotate clockwise about the central axle as indicated by an arrow. The charging unit 30 is used for charging the photo-conductor 20. The exposure unit 40 is used for forming a latent image on the charged photo-conductor 20 by irradiation with laser beams. The exposure unit 40 irradiates the charged photo-conductor 20 with modulated laser beams in accordance with an image signal. By turning the laser beams on and off at a predetermined timing while rotating the photo-conductor 20 at a predetermined speed, dot latent images are formed on the photo-conductor 20 in regions partitioned in a grid pattern.

The developer container holder 50 is used for developing the latent image formed on the photo-conductor 20 using black (K) toner accommodated in a black developer container 51, magenta (M) toner accommodated in a magenta developer container 52, cyan (C) toner accommodated in a cyan developer container 53, and yellow (Y) toner accommodated in a yellow developer container 54. In the developer container holder 50, the positions of the developer containers 51, 52, 53, and 54 can be moved by rotating the developer container holder 50. For each time the photo-conductor 20 rotates 360 degrees, one of the developer containers 51, 52, 53, and 54 selectively faces the photo-conductor 20, and a latent image formed on the photo-conductor 20 is developed in sequence using the toner accommodated in one of the developer containers 51, 52, 53, and 54 that faces the photo-conductor 20.

The primary transfer unit 60 is used for transferring a single-color toner image formed on the photo-conductor 20 to the intermediate transfer belt 70. When four-color toners are transferred so as to overlap with each other, a full-color toner image is formed on the intermediate transfer belt 70. The intermediate transfer belt 70 is an endless belt and is rotated at substantially the same peripheral speed as that of the photo-conductor 20. The secondary transfer unit 80 is used for transferring the single-color toner image or the full-color toner image formed on the intermediate transfer belt 70 to a recording medium such as a sheet, a film, or a cloth.

The fixing unit 90 is used for fixing the single-color toner image or the full-color toner image transferred onto the recording medium such as a sheet by fusion to form a permanent image. The cleaning unit 75 is disposed between the primary transfer unit 60 and the charging unit 30, and includes a cleaning blade 76 made of rubber that is in contact with the surface of the photo-conductor 20. After the toner image is transferred onto the intermediate transfer belt 70 using the primary transfer unit 60, the cleaning unit 75 is used for removing toner T left on the photo-conductor 20 by scraping it using the cleaning blade 76.

The developer container holder 50 includes the black developer container 51 that accommodates black (K) toner, the magenta developer container 52 that accommodates magenta (M) toner, the cyan developer container 53 that accommodates cyan (C) toner, and the yellow developer container 54 that accommodates yellow (Y) toner. Since the structure of each of the developer containers is the same, only a structure of the cyan developer container 53 is described below.

Figure 5:
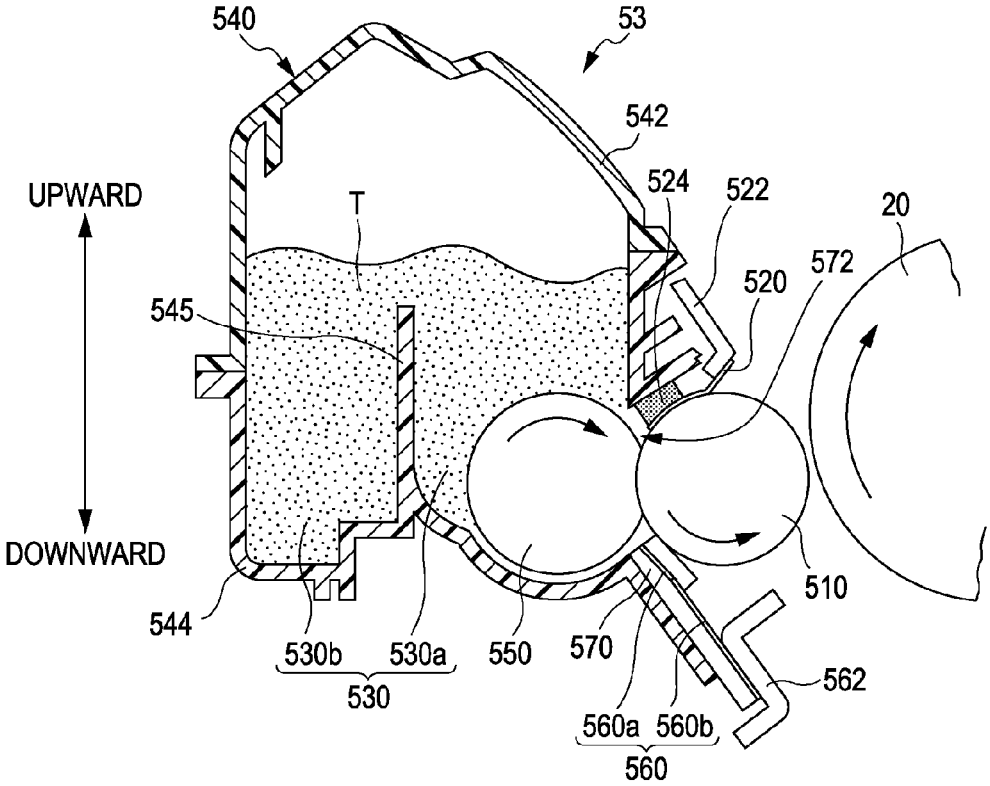
FIG. 5 is a sectional view for describing principal elements of a developing apparatus.

FIG. 5 is a sectional view for describing principal elements of a developer container represented by the cyan developer container 53. The developer container 53 includes a housing 540 that accommodates toner T, a developing roller 510 that is an example of a toner particle carrying roller for carrying toner, a toner supplying roller 550 for supplying toner to the developing roller 510, a regulating blade 560 that is an example of a layer thickness regulating member for regulating the layer thickness of the toner carried by the developing roller 510, an upper seal 520 for sealing the gap on the upper side between the housing 540 and the developing roller 510, and an end seal 527 for sealing the gap on the end side between the housing 540 and the developing roller 510.

The housing 540 is made by welding an upper housing portion 542 to a lower housing portion 544, each of which is composed of a resin and integrally formed. Inside the housing 540, a toner container 530 is formed for accommodating the toner T. The toner container 530 is divided into two toner containers, that is, a first toner container 530*a* and a second toner container 530*b* through a partition wall 545 that protrudes inward from the inner wall (in an up-down direction of FIG. 5) to partition the toner T.

The upper portions of the first toner container 530*a* and the second toner container 530*b* communicate with each other. In the state shown in FIG. 4, the movement of the toner T is regulated by the partition wall 545. However, when the developer container holder 50 rotates, the toners accommodated in the first toner container 530*a* and the second toner container 530*b* are once gathered at the upper portions communicating with each other. When the state shown in FIG. 4 is changed to the state shown in FIG. 5, the toners are mixed and returned to the first toner container 530*a* and the second toner container 530*b*. In other words, by rotating the developer container holder 50, the toner T accommodated in the developer container is stirred. Therefore, a stirring member is not disposed in the toner container 530 in this embodiment, but a stirring member for stirring the toner T accommodated in the toner container 530 may be disposed. As shown in FIG. 5, the housing 540 has an opening 572 at the lower portion thereof, and the developing roller 510 described below is disposed so as to face the opening 572.

The toner supplying roller 550 includes a roller portion 550*a* composed of, for example, urethane foam with elasticity and an axle body 550*b* about which the roller portion 550*a* rotates. The toner supplying roller 550 is supported by the housing 540 at both ends of the axle body 550*b*, whereby the toner supplying roller 550 is supported rotatably about the axle body 550*b*. The roller portion 550*a* is accommodated in the first toner container 530*a* of the housing 540 (in the housing 540) and supplies the toner T accommodated in the first toner container 530*a* to the developing roller 510. The toner supplying roller 550 is disposed under the first toner container 530*a* in a vertical direction. The toner T accommodated in the first toner container 530*a* is supplied to the developing roller 510 through the toner supplying roller 550 at the lower portion of the first toner container 530*a*. The toner supplying roller 550 also removes toner T excessively left on the developing roller 510 after development from the developing roller 510.

The toner supplying roller 550 and the developing roller 510 are attached to the housing 540 while both rollers are pressed against each other. Therefore, the roller portion 550*a* of the toner supplying roller 550 is in contact with the developing roller 510 while being elastically deformed. The toner supplying roller 550 rotates in a direction (in a clockwise direction in FIG. 4) opposite to the rotational direction (in an counterclockwise direction in FIG. 5) of the developing roller 510. The axle body 550*b* is located at a position lower than that of the rotational axis of the developing roller 510.

The developing roller 510 carries the toner T and transfers it to a developing position that faces the photo-conductor 20. The developing roller 510 is composed of a metal such as an aluminum alloy including a 5056 aluminum alloy or a 6063 aluminum alloy or an iron alloy including carbon steel for machine structural purpose (STKM). If necessary, nickel plating or chromium plating may be performed on the developing roller 510. On the surface of the developing roller 510, a spiral groove is formed at the central portion in the axis direction of the developing roller 510. The surface profile of the developing roller 510 will be described later.

The developing roller 510 is supported at both ends in the longitudinal direction thereof, and thus can rotate about the central axle thereof. As shown in FIG. 5, the developing roller 510 rotates in a direction (in a counterclockwise direction in FIG. 5) opposite to the rotational direction (in a clockwise direction in FIG. 5) of the photo-conductor 20. The central axle is located at a position lower than that of the central axle of the photo-conductor 20.

As shown in FIG. 5, when the cyan developer container 53 faces the photo-conductor 20, there is a gap between the developing roller 510 and the photo-conductor 20. That is, the cyan developer container 53 develops a latent image formed on the photo-conductor 20 in a noncontact manner. When the latent image formed on the photo-conductor 20 is developed, an alternating electric field is formed between the developing roller 510 and the photo-conductor 20.

The regulating blade 560 provides a charge to the toner T carried by the developing roller 510 and regulates the layer thickness of the toner T. The regulating blade 560 includes a rubber portion 560*a* and a rubber supporting portion 560*b*. The rubber portion 560*a* is composed of silicon rubber, urethane rubber, or the like and the rubber supporting portion 560*b* is a thin plate composed of phosphor bronze, stainless steel, or the like and having a characteristic of spring. The rubber portion 560*a* is supported by the rubber supporting portion 560*b* at one end in the transverse direction of the rubber supporting portion 560*b* so as to extend in the longitudinal direction of the rubber supporting portion 560*b*. The rubber supporting portion 560*b* is attached to the housing 540 through a blade supporting metal sheet 562 while supported by the blade supporting metal sheet 562 at the other end thereof. Furthermore, a blade rear member 570 composed of moltopren is disposed on the side of the regulating blade 560 opposite the developing roller 510 side.

The rubber portion 560*a* is pressed against the developing roller 510 from the central portion to both end portions of the developing roller 510 by the elastic force exerted due to the bending of the rubber supporting portion 560*b*. The blade rear member 570 prevents the toner T from entering a space between the rubber supporting portion 560*b* and the housing 540 and stabilizes the elastic force exerted due to the bending of the rubber supporting portion 560*b*. Furthermore, the blade rear member 570 urges the rubber portion 560*a* in the direction from the back of the rubber portion 560*a* toward the developing roller 510, whereby the rubber portion 560*a* is pressed against the developing roller 510. Thus, the rubber portion 560*a* is brought into contact with the developing roller 510 more uniformly because of the blade rear member 570.

The end of the regulating blade 560 on the side opposite the side on which the regulating blade 560 is supported by the blade supporting metal sheet 562, that is, the free end is not in contact with the developing roller 510. Only a portion having a certain width and that is spaced apart from the free end by a certain distance is in contact with the developing roller 510. In other words, the edge of the regulating blade 560 is not in contact with the developing roller 510, and the flat surface of the rubber portion 560*a* is in contact with the developing roller 510. The regulating blade 560 is disposed such that the free end is oriented in the upstream direction of the rotation of the developing roller 510, that is, the regulating blade 560 is in so-called counter contact with the developing roller 510. The regulating blade 560 is in contact with the developing roller 510 at a position lower than that of the central axle of the developing roller 510 and also lower than that of the central axle of the toner supplying roller 550.

The rubber supporting portion 560*b* is disposed so as to be longer than the rubber portion 560*a* in the axis direction of the developing roller 510, and extends outward from both ends of the rubber portion 560*a*. In the extending region of the rubber supporting portion 560*b*, the end seal 527 having a thickness larger than that of the rubber portion 560*a* and composed of a nonwoven fabric or the like is attached to the surface on the same side as the rubber portion 560*a*. Herein, the end face of the rubber portion 560*a* in the axis direction of the developing roller 510 is in contact with the side face of the end seal 527.

The end seal 527 is disposed so as to be in contact with both end portions of the developing roller 510 when the developing roller 510 is mounted. Both the end portions are portions of the surface where a groove is not formed. The end seal 527 has a width that protrudes outward from the end portions of the developing roller 510. The end seal 527 extends from the free end of the rubber portion 560*a* of the regulating blade 560 by a sufficiently long distance. When the regulating blade 560 is attached to the housing 540, the end seal 527 is disposed along the portion of the housing 540 formed so as to face the outer surface of the developing roller 510, to seal the gap between the housing 540 and the developing roller 510.

The upper seal 520 prevents the toner T accommodated in the cyan developer container 53 from leaking to the outside of the cyan developer container 53, and collects the toner T, on the developing roller 510, that has passed through the developing position into the developer container without scraping it. The upper seal 520 is composed of a polyethylene film or the like. The upper seal 520 is supported by a seal supporting metal sheet 522, and attached to the housing 540 through the seal supporting metal sheet 522. Furthermore, a seal urging member 524 composed of moltopren or the like is disposed on the side of the upper seal 520 opposite the developing roller 510 side. The upper seal 520 is pressed against the developing roller 510 by the elastic force of the seal urging member 524. The upper seal 520 is in contact with the developing roller 510 at a position higher than that of the central axle of the developing roller 510.

Operation of Cyan Developer Container

In the cyan developer container 53 having such a structure, the toner supplying roller 550 supplies the toner T accommodated in the toner container 530 to the developing roller 510. The toner T supplied to the developing roller 510 reaches a contact position with the regulating blade 560 as the developing roller 510 rotates. When the toner T passes through the contact position, a charge is provided to the toner T and the layer thickness of the toner T is regulated.

The charged toner T on the developing roller 510 reaches a developing position that faces the photo-conductor 20 as the developing roller 510 further rotates, and is used for development of the latent image formed on the photo-conductor 20 under an alternating electric field at the developing position. The toner T, on the developing roller 510, that has passed through the developing position due to the further rotation of the developing roller 510 passes through the upper seal 520 and is collected into the developer container without being scraped by the upper seal 520. The toner T still left on the developing roller 510 is removed by the toner supplying roller 550.

Surface Profile of Developing Roller

Figure 6:
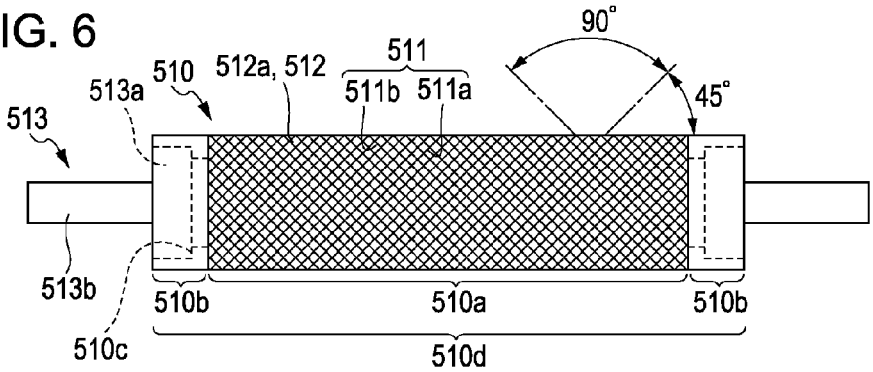
FIG. 6 is a plan view for describing a surface profile of a developing roller.
Figure 7:
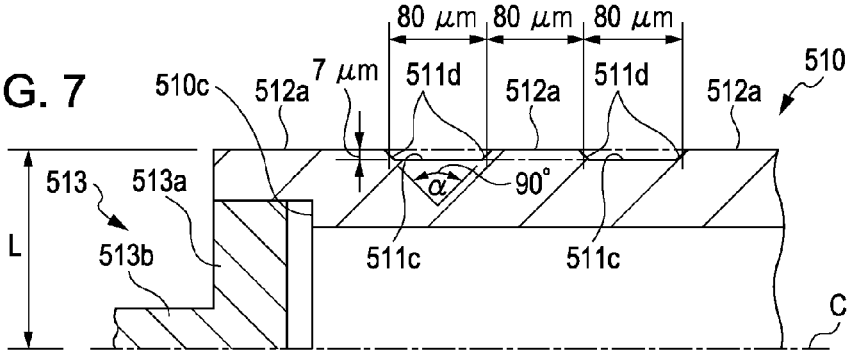
FIG. 7 is a sectional view for describing a section of the developing roller taken along a plane including the axle of the developing roller.

FIG. 6 is a conceptual diagram for describing a surface profile of the developing roller. FIG. 7 is a sectional view for describing a section of the developing roller taken along a plane including the axle of the developing roller. In FIG. 6, the groove of the surface of the developing roller 510 is illustrated in a straight line for convenience. In reality, however, since the groove is formed in a spiral manner, it is supposed to be seen as a curved line.

The developing roller 510 has projections and depressions for carrying toner particles at the central portion 510*a* in the axis direction and also has smooth surfaces at both end portions 510*b* such that the end seals 527 are brought into close contact with the end portions 510*b*.

As shown in FIG. 6, a spiral groove 511 formed with a constant pitch in the axis direction so as to be inclined with respect to the axis direction and the circumferential direction of the developing roller 510 is formed in the central portion 510*a* of the developing roller 510 according to this embodiment. The groove 511 is constituted by two types of the groove 511, that is, a first groove 511*a* and a second groove 511*b*, each of which has a different angle of inclination with respect to the axis direction and the circumferential direction of the developing roller 510. The first and second grooves 511*a* and 511*b* intersect each other to form a grid such that the top face 512*a* of a projection 512 surrounded by the first and second grooves 511*a* and 511*b* has a substantially square shape. The first and second grooves 511*a* and 511*b* are formed such that one of two diagonal lines of the square shape of the top face 512*a* of the projection 512 extends in the circumferential direction.

That is, the first groove 511*a* is formed in a spiral shape so as to be inclined clockwise by 45° with respect to the axle of the developing roller 510. The second groove 511*b* is formed in a spiral shape so as to be inclined counterclockwise by 45° with respect to the axle of the developing roller 510. Therefore, the first groove 511*a* and the second groove 511*b* intersect each other at 90°. Since the pitches of the first and second grooves 511*a* and 511*b* in the axis direction of the developing roller 510 are equally formed, the top face 512*a* of the projection 512 surrounded by the first and second grooves 511*a* and 511*b* has a substantially square shape.

As shown in FIG. 7, the two types of the groove 511 are each formed with a pitch of 80 μm in the axis direction of the developing roller 510. An inclined portion 511*d* from the top face 512*a* of the projection 512 to a bottom face 511*c* of the groove 511 is formed such that the crossing angle a of imaginary surfaces obtained by extending two inclined surfaces of the inclined portion 511*d* in the direction toward an axle C is 90°.

The two types of the groove 511 are each formed such that the depth of the groove 511, that is, the distance from the top face 512*a* of the projection 512 to the bottom face 511*c* of the groove 511 is constant, specifically about 7 μm. The depth of the groove 511 is preferably set to 1.5 times or more and 3.0 times or less the volume-average particle size of the toner. When the volume-average particle size of the toner is 4 μm, the depth of the groove 511 is set to 6 μm or more and 12 μm or less.

Figure 8:
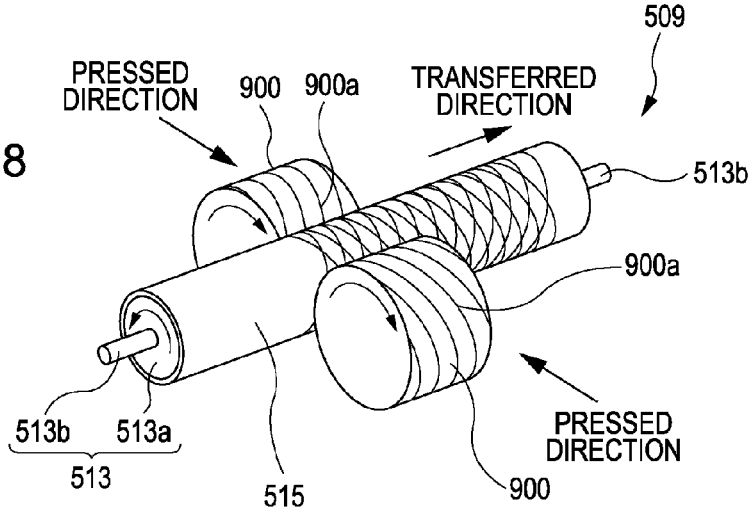
FIG. 8 is a perspective view for describing the formation of the developing roller by rolling.
Figure 9:
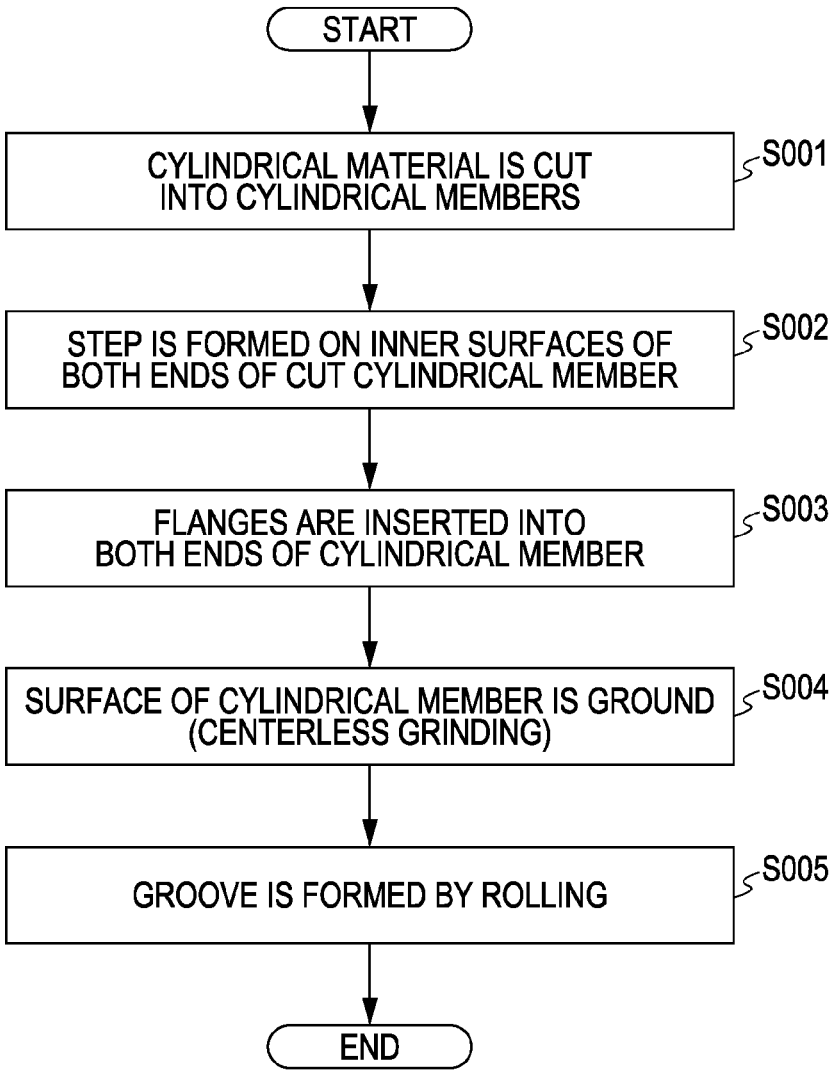
FIG. 9 is a flow chart showing a procedure of forming the developing roller.

Such a developing roller 510 is formed by rolling. FIG. 8 is a perspective view for describing the formation of the developing roller 510 by rolling. FIG. 9 is a flow chart showing a procedure of forming the developing roller.

The developing roller 510 is formed of a cylindrical hollow material. First, the cylindrical material is cut into cylindrical members 515 each having a sufficient length such that the central portion 510*a* for carrying toner and the end portions 510*b* brought into contact with the end seal 527 can be formed (S001). In the cylindrical member 515, *a* step 510*c* (FIG. 6) used for inserting a flange 513 having the axle of the developing roller 510 into the inner surface of each of the end portions of the developing roller 510 is formed by cutting (S002). The flange 513 includes a disc-shaped flange body 513*a* having a certain diameter that allows the press-fitting thereof into the formed step 510*c* and a shaft 513*b* that protrudes from the center of the flange body 513*a* in the direction vertical to the disc-shaped surface.

Next, the flange 513 having the shaft 513*b* is inserted into the cylindrical member 515 in which the step 510*c* has been formed on the inner surface of each of the end portions such that the shaft 513*b* protrudes outward from the cylindrical member 515 (S003).

Subsequently, the cylindrical member 515 into which the flange 513 is inserted rotates about an axle formed by supporting the shafts 513*b* of both end portions of the cylindrical member 515, whereby the entire outer surface of the cylindrical member 515 is cut by a small amount. Consequently, the surface of the cylindrical member 515 is ground such that the entire region on the surface is made concentric with the axle, that is, the distance L from the axle is made constant, to form a non-rolled developing roller 509 (S004).

In the cylindrical member 515 whose surface has been ground, two types of grooves 511*a* and 511*b* are formed on the surface by rolling using an apparatus including dies 900 as processing tools shown in FIG. 8 (S005). In the rolling apparatus, a workpiece (herein, the non-rolled developing roller 509) is placed between the two dies 900 that are disposed so as to face each other and rotate in the same direction. The two dies 900 are pressed against the non-rolled developing roller 509. The non-rolled developing roller 509 is transferred in the axis direction thereof while being rotated in the direction opposite to the rotational direction of the dies 900. Each of the dies 900 includes a blade 900*a* for forming the grooves 511*a* and 511*b*. The blades 900*a* of the dies 900 are inclined such that the grooves 511*a* and 511*b* to be formed in the surface of the non-rolled developing roller 509 using the blades 900*a* are orthogonal to each other. Herein, the portions of the dies 900 in contact with the surface of the non-rolled developing roller 509 are the blades 900*a*. However, a workpiece is not actively cut in the rolling, but is compressed by a pressing force to form a depression. Furthermore, when the rolling is performed, the dies 900 are not brought into contact with both end portions 510*b* of the non-rolled developing roller 509 to leave smooth surfaces having no depressions and projections on the end portions 510*b*. That is, the top face 512*a* of the projection 512 with which the dies 900 are not brought into contact at the central portion 510*a* of the developing roller 510 and the end portions 510*b* not subjected to rolling are at a constant distance L from the axle C. Most of the surface 510*d* of the developing roller 510 is covered with the bottom faces 511*c* of the grooves 511*a* and 511*b* subjected to the contact with the dies 900 and the non-processed surface not subjected to the contact with the dies 900. For example, electroless Ni—P plating, electroplating, or hard chromium plating may be optionally performed on the developing roller 510 formed by rolling.

Toner is supplied from the toner supplying roller 550 to a region between the end seals 527 brought into contact with the end portions 510*b* of the developing roller 510. The layer thickness of the toner layer is regulated at a pressing position of the regulating blade 560. In this case, the regulating blade 560 presses the developing roller 510 over the end portions 510*b* and the central portion 510*a*. However, since the end portions 510*b* of the developing roller 510 and the top face

512*a* of the projection 512 are at the same distance L from the axle C, the regulating blade 560 presses the developing roller 510 while remains substantially flat without being significantly bended. Therefore, an excessively large gap is not formed between the surface 510*d* of the developing roller 510 and the regulating blade 560, for example, even at the boundary between the end portions 510*b* and the central portion 510*a*.

Furthermore, since the depth of the groove 511 is three times or less the volume-average particle size of the toner particles T, more than three toner particles are never stacked in the depth direction at any position in the groove 511. In other words, a large amount of toner particles does not enter the groove 511. When the regulating blade 560 presses the developing roller 510, most of the toner particles are brought into contact with at least one of the surface 510*d* of the developing roller 510 and the surface of the regulating blade 560. Therefore, the toner particles T are easily rolled, and can be charged appropriately because the toner particles T do not easily remain in the groove 511. Thus, the toner particles are carried by the developing roller 510 with certainty and used for development. In addition, since an excessively large gap is not formed between the surface 510*d* of the developing roller 510 and the regulating blade 560, the toner particles T can be prevented from leaking to the outside of the developer containers 51, 52, 53, and 54.

Figure 10:
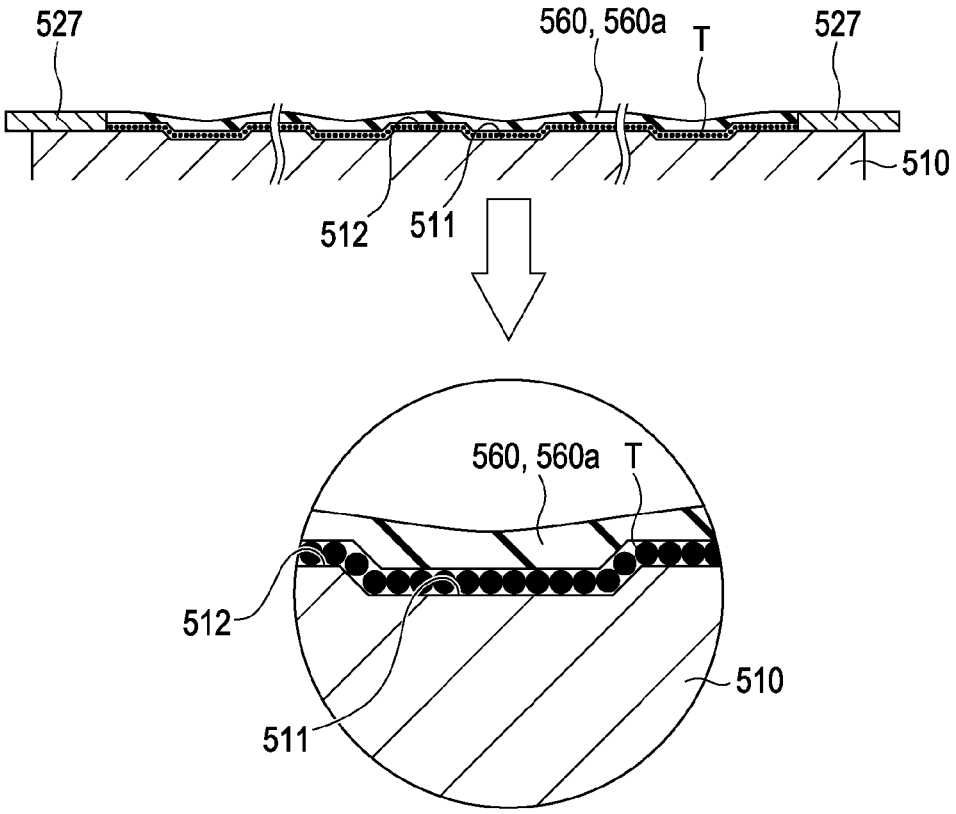
FIG. 10 is a diagram for describing the state in which a regulating blade is brought into contact with a developing roller that carries toner particles.

FIG. 10 is a diagram for describing the state in which the regulating blade is brought into contact with the developing roller that carries toner particles. The groove 511 of the developing roller 510 according to this embodiment has a depth of 7 μm, which is set to 1.5 times or more and 3.0 times or less the volume-average particle size (4 μm) of the toner particles T. The regulating blade 560 made of rubber follows the depressions and projections of the surface 510*d* of the developing roller 510. Therefore, the toner particles T can be charged with certainty in the entire region including the projection 512 and the groove 511 of the central portion 510*a*. Moreover, the toner particles T are carried by the developing roller 510 with certainty to improve ease of transference during development, and can be prevented from leaking to the outside of the developer container.

If depressions and projections having a nonuniform size, depth, shape, and the like are formed on the surface 510*d* of the developing roller 510, the carried toner particles T that have entered deep depressions are not easily rolled and charged. If the groove is formed in the circumferential direction at a certain pitch in the axis direction, the relative position of the photo-conductor 20 that faces the groove is not changed in the axis direction of the photo-conductor 20 even when the photo-conductor 20 rotates. Therefore, the developed toner image may have a high concentration only at a portion that has faced the groove. On the other hand, if the groove is formed in the axis direction, the direction of the groove is substantially orthogonal to the rotational direction of the toner particle carrying roller. Thus, the carried toner particles are not easily rolled and charged.

In the developer containers 51, 52, 53, and 54 and the developing roller 510 according to this embodiment, the spiral groove 511 is formed on the surface 510*d* of the developing roller 510 with a constant pitch so as to be inclined with respect to the axis direction and the circumferential direction. Since the toner particles T are moved by rolling as the developing roller 510 rotates, the toner particles T can be charged appropriately. Furthermore, since the positions of the photo-conductor 20 and the groove 511 facing each other are relatively changed in the axis direction and the circumferential direction as the developing roller 510 rotates, the occurrence of the concentration unevenness on the developed toner image can be suppressed.

In the developing roller 510 according to this embodiment, since two types of grooves 511*a* and 511*b* each having a different angle of inclination are formed, toner particles T are moved in two directions along the grooves 511*a* and 511*b*. Therefore, the toner particles T can be prevented from being moved only in a certain single direction in an unbalanced manner. Furthermore, since the two grooves 511*a* and 511*b* intersect each other to form a grid, toner particles T that have started to roll along the first groove 511*a* (second groove 511*b*) can then roll along the second groove 511*b* (first groove 511*a*). Thus, the movement direction of the toner particles T can be effectively prevented from being unbalanced.

Since the top face 512*a* of the projection 512 surrounded by the two types of groove 511 has a square shape and one of two diagonal lines of the square shape extends in the circumferential direction, the projection 512 has two vertical angles located in the circumferential direction and two vertical angles located in the axis direction, all of the vertical angles being right angles. Therefore, the two grooves 511*a* and 511*b* have the same angle of inclination with respect to the circumferential direction and the axis direction. Consequently, the toner particles T are easily moved in the circumferential direction as well as the axis direction. Thus, the toner particles can be rolled more uniformly and uniformly charged.

For the toner particles T carried on the surface of the developing roller 510, since the layer thickness is regulated with the flat surface of the rubber portion 560*a* equipped with the regulating blade 560, the toner particles T carried on the surface of the developing roller 510, in particular on the projection 512, are not scraped by the regulating blade 560 completely. In other words, the layer thickness of the toner particles T can be regulated while the toner particles T are carried on both the groove 511 and the projection 512 of the developing roller 510. Furthermore, since the toner particles T carried on the surface 510*d* are pressed by the flat surface of the regulating blade 560, the toner particles T can be charged appropriately by friction between the toner particles T and the surface of the developing roller 510, between the toner particles T and the regulating blade 560, and between the toner particles T.

When a developing apparatus can be resupplied with toner, mixed toner of residual toner and newly supplied toner is used. When a developing apparatus cannot be resupplied with toner, mixed toner of residual toner and newly loaded toner is used.

The invention will now be described in detail with Examples.

EXAMPLES

Example 1

Preparation of Toner

After 2 kg of toner base particles obtained by phase inversion emulsification were placed in a Henschel mixer (20 L), 2.0 g of alumina fine particles (TAIMICRON TM-100 ($Al_2O_3$) whose main phase is a θ-alumina phase and that has a primary particle size of 14 nm and a BET specific surface area of 132 $m^2/g$ (available from TAIMEI CHEMICALS Co., Ltd.)) were placed in the Henschel mixer as an addition amount per 100 g of toner base particles (the same shall apply hereinafter) to perform processing at a peripheral speed of 40 m/s for 2 minutes.

Next, 2.0 g of hydrophobic monodispersed spherical large silica particles (KEP10S2 available from NIPPON SHOKUBAI Co., Ltd. having a primary particle size of 100 nm and processed with silicone oil) and 2.0 g of hydrophobic small silica particles (RX200 available from NIPPON AEROSIL Co., Ltd. having a primary particle size of 12 nm and is processed with hexamethyldisilazane (HMDS)) were placed in the Henschel mixer to perform processing at a peripheral speed of 40 m/s for 2 minutes.

After the treatment, coarse particles were removed using a sonic sifter with a metal mesh having an opening of 63 μm to prepare toner of the invention.

Example 2

Toner of Example 2 was prepared in the same manner as in Example 1, except that the alumina fine particles were changed to 0.5 g of TAIMICRON TM-300 ($Al_2O_3$) whose main phase is a γ-alumina phase and that has a primary particle size of 7 nm and a BET specific surface area of 225 $m^2/g$ (available from TAIMEI CHEMICALS Co., Ltd.).

Example 3

Toner of Example 3 was prepared in the same manner as in Example 1, except that the alumina fine particles were changed to 2.0 g of Nano•Tek ($Al_2O_3$) having a primary particle size of 30 nm and a BET specific surface area of 49.3 $m^2/g$ (available from C. I. Kasei Company, Limited).

Comparative Example 1

Toner of Comparative Example 1 was prepared in the same manner as in Example 1, except that the alumina fine particles were changed to 1.0 g of AEROXIDE C805 whose crystal system (ratio) is γ phase 2/3 and δ phase 1/3 and that has a primary particle size of 13 nm and a BET specific surface area of 100 $m^2/g$ (available from NIPPON AEROSIL Co., Ltd.).

Comparative Example 2

Toner of Comparative Example 2 was prepared in the same manner as in Example 1, except that the alumina fine particles were changed to 2.0 g of titania fine particles STT30S (available from Titan Kogyo, Ltd.).

Image Formation

Each of the obtained toners was loaded into the image forming apparatus (LP9000C available from SEIKO EPSON CORPORATION) shown in FIG. 4.

A developing roller was formed by rolling. The surface of a hollow open pipe made of iron and having a diameter of 18 mm and a length of 370 mm had a shape shown in FIGS. 6 and 7. That is, the surface had a spiral groove formed with a pitch of 80 μm at an angle of 45° with respect to the axis direction and the circumferential direction. The groove had a depth of 7 μm, the projection had a width of 30 μm, and the depression had a width of 50 μm.

A layer thickness regulating member had a thickness of 2 mm. The layer thickness regulating member was composed of silicon rubber or urethane rubber having a rubber hardness of 65 degrees (JIS-A standard) and supported by a layer thickness regulating member supporting member. The layer thickness regulating member supporting member included a thin plate and a thin plate supporting member and supported the layer thickness regulating member at one end in the transverse direction thereof. The thin plate composed of phosphor bronze, stainless steel, or the like had a thickness of 0.15 mm and a characteristic of spring. The thin plate directly supported the layer thickness regulating member and pressed the layer thickness regulating member against the developing roller using an urging force. The regulation form of the layer thickness regulating member used herein was a regulation form (so-called edge regulation) in which the edge in the transverse and thickness directions of the layer thickness regulating member is located within a contact nip having a certain width. A supplying roller composed of an urethane sponge having an outer diameter of ϕ19 and an Asker F hardness of 70° was brought into contact with the developing roller with pressure at a contact depth of 1 mm.

A color image was formed by AC jumping development under the following conditions:

- processing speed (peripheral speed of photo-conductor): 210 mm/s
- dark potential of photo-conductor: −550 V
- light potential of photo-conductor: −50 V
- peripheral speed of developing roller: 336 mm/s
- peripheral speed of supplying roller: 504 mm/s
- peripheral speed ratio of photo-conductor to developing roller: 1.6
- peripheral speed ratio of developing roller to supplying roller: 1.5
- photo-conductor/developing roller gap: 100 μm
- photo-conductor/developing roller AC bias component Vpp: 1100 V
- photo-conductor/developing roller DC bias component Vdc: −300 V
- photo-conductor/developing roller AC frequency (f): 6 kHz
- photo-conductor/developing roller AC duty (ratio of applied time on the removing side): 60%

A toner amount adjusting patch sensor was not allowed to operate. The test environment was 22 to 24° C. and 45 to 55% RH.

Evaluation items and methods for the toners of Examples 1 to 3 and Comparative Examples 1 and 2 using an actual image forming apparatus will now be described. Tables 8 and 9 show the evaluation results.

(1) Flight Behavior (OD value)

A flight behavior represents development performance when a full page solid image is formed, and is expressed by the magnitude and uniformity of the image concentration. An average OD value and the minimum OD value at nine areas in total (the combination of three areas of front end/center/rear end of an image with three areas of left side/center/right side of the image) are used.

Lv 4 (Good): an average OD value of 1.30 or more and a minimum OD value of 1.20 or more Lv 3 (Fair): an average OD value of 1.20 or more and a minimum OD value of 1.10 or more Lv 2 (Poor): an average OD value of 1.10 or more and less than 1.20

Lv 1 (Poor): an average OD value of less than 1.10

(2) Supply Delay

A supply delay is a phenomenon in which the uniformity of an image concentration in the sheet transferring direction (subscanning direction of exposure) from the second developing roller cycle to the rear end of a solid image is decreased compared to the uniformity in the first developing roller cycle, that is, a decrease in concentration (thinner spot) is caused. The supply delay was determined through visual inspection.

Lv 4 (Good): Concentration is not decreased at all in the region from the front end of an image formed during the first developing roller cycle to the rear end (cannot be determined even by looking through it).

Lv 3 (Good): Concentration is not decreased in the region from the front end of an image formed during the first developing roller cycle to the rear end (can be determined by looking through it).

Lv 2 (Fair): Concentration is decreased because of supply delay in part of the region where an image is formed after the second developing roller cycle.

Lv 1 (Fair): Concentration is decreased because of supply delay in more than half of the region where an image is formed after the second developing roller cycle.

(3) Leakage During Regulation

Leakage during regulation is a phenomenon in which when a toner layer on a developing roller passes through a regulating blade, part of toner is not held by the developing roller and thus leaks out. The leakage during regulation was evaluated using the following four grades through visual inspection. Lv 3 or higher based on the following determination criteria is acceptable.

Lv 4 (Good): Toner does not leak from the regulating blade to the developing roller at all, and there is no stain caused by the toner.

Lv 3 (Fair): Toner leakage occurs intermittently when the developing roller rotates, and amounts of toner having a size of smaller than a sesame seed adhere to a base material but the base material can be seen.

Lv 2 (Poor): Toner leakage occurs intermittently when the developing roller rotates, and amounts of toner adhere to a base material to an extent that the base, material cannot be seen.

Lv 1 (Poor): Toner leakage occurs continuously when the developing roller rotates, and toner leaks out endlessly.

(4) Scattering at Upper Seal

Scattering at an upper seal is a phenomenon in which when a toner layer on a developing roller passes through an upper seal, part of toner is not held by the developing roller and is scattered. Scattering at an upper seal was evaluated using the following four grades through visual inspection. The determination criteria are as follows.

Lv 4 (Good): Toner on the developing roller is not scattered at all at an upper seal collection member, and there is no stain caused by the toner.

Lv 3 (Fair): Scattered toner thinly adheres to part of a holder/housing to an extent that a base material can be seen.

Lv 2 (Poor): Scattered toner is stacked onto part of a holder/housing to an extent that a base material cannot be seen.

Lv 1 (Poor): Scattered toner is stacked onto more than half area of a holder/housing to an extent that a base material cannot be seen.

(5) Developing Gap Scattering

Developing gap scattering is a phenomenon in which when toner on a developing roller is transferred to a photo-conductor, part of the toner activated through reciprocation in an alternating current electric field applied between the photo-conductor and the developing roller rides an ambient airflow without being caught in a development electric field and is scattered to the surroundings. Scattering is quantified as follows. The adhesion state of toner caught on the surface of an adhesive tape having a size of 1 cm×1 cm and located at a point, as a ridgeline, that is 10 mm away from a point of closest approach between the photo-conductor and the developing roller in a direction perpendicular to an imaginary line that connects the central axle of the photo-conductor to the central axle of the developing roller, is compared with that of a boundary sample of a magnified image prepared using a microscope in advance to determine a score from the following grades.

Lv 4 (Good): The number of toner particles caught on the adhesive surface is 5 or less per 1 $cm^2$.

Lv 3 (Fair): The number of toner particles caught on the adhesive surface is more than 5 and 20 or less per 1 $cm^2$.

Lv 2 (Poor): The number of toner particles caught on the adhesive surface is more than 20 and 100 or less per 1 $cm^2$.

Lv 1 (Poor): The number of toner particles caught on the adhesive surface is more than 100 per 1 $cm^2$.

(6) Fogging (OD Value)

The fogging amount on a photo-conductor (OPC) was determined as follows. By forcedly stopping an image forming process in the middle of the process when a white solid pattern is printed, fogging toner of the white solid (background) left on the photo-conductor is transferred and collected using a mending tape (available from Sumitomo 3M Limited). The mending tape after the transference and collection is attached to J paper (available from Fuji. Xerox Co., Ltd.), and the change in the concentration on the tape is measured as an OD value (optical reflection concentration) using a Macbeth densitometer. Since the tape itself has an OD value of about 0.1, the fogging toner concentration is determined by subtracting the OD value of the tape itself from the measured OD value.

Lv 4 (Good): The OD value for fogging toner is 0.10 or less.

Lv 3 (Fair): The OD value for fogging toner is 0.15 or less and more than 0.10.

Lv 2 (Poor): The OD value for fogging toner is 0.20 or less and more than 0.15.

Lv 1 (Poor): The OD value for fogging toner is more than 0.20.

(7) Leakage During Regulation After Toner Supply

A white solid image corresponding to 6,000 A4-size sheets is formed to consume fogging toner. Subsequently, a developing apparatus is resupplied with new toner in an amount corresponding to 10% of residual toner by weight. A phenomenon is observed in which leakage during regulation of a toner layer on a developing roller temporarily increases immediately after the developing apparatus is resupplied with the new toner. The leakage during regulation after toner supply is determined by performing the same procedure as that of the leakage during regulation of normal fogging.

Lv 4 (Good): Toner does not leak from the regulating blade to the developing roller at all, and there is no stain caused by the toner.

Lv 3 (Fair): Toner leakage occurs intermittently when the developing roller rotates, and amounts of toner having a size of smaller than a sesame seed adhere to a base material but the base material can be seen.

Lv 2 (Poor): Toner leakage occurs intermittently when the developing roller rotates, and amounts of toner adhere to a base material to an extent that the base material cannot be seen.

Lv 1 (Poor): Toner leakage occurs continuously when the developing roller rotates, and toner leaks out endlessly.

(8) Scattering at Upper Seal After Toner Supply

A white solid image corresponding to 6,000 A4-size sheets is formed to consume fogging toner. Subsequently, a developing apparatus is resupplied with new toner in an amount corresponding to 10% of residual toner by weight. There is observed a phenomenon in which scattering at an upper seal of a toner layer on a developing roller temporarily increases immediately after the developing apparatus is resupplied with the new toner. The scattering at an upper seal after toner supply is determined by performing the same procedure as that of the leakage during regulation of normal fogging.

Lv 4 (Good): Toner on the developing roller is not scattered at all at an upper seal collection member, and there is no stain caused by the toner.

Lv 3 (Fair): Scattered toner thinly adheres to part of a holder/housing to an extent that a base material can be seen.

Lv 2 (Poor): Scattered toner is stacked onto part of a holder/housing to an extent that a base material cannot be seen.

Lv 1 (Poor): Scattered toner is stacked onto more than half area of a holder/housing to an extent that a base material cannot be seen.

(9) Developing Gap Scattering After Toner supply

A white solid image corresponding to 6,000 A4-size sheets is formed to consume fogging toner. Subsequently, a developing apparatus is resupplied with new toner in an amount corresponding to 10% of residual toner by weight. There is observed a phenomenon in which developing gap scattering that is caused on the white solid image formed immediately after the developing apparatus is resupplied with the new toner temporarily increases. The developing gap scattering after toner supply is determined by performing the same procedure as that of normal fogging.

Lv 4 (Good): The number of toner particles caught on the adhesive surface is 5 or less per 1 $cm^2$.

Lv 3 (Fair): The number of toner particles caught on the adhesive surface is more than 5 and 20 or less per 1 $cm^2$.

Lv 2 (Poor): The number of toner particles caught on the adhesive surface is more than 20 and 100 or less per 1 $cm^2$.

Lv 1 (Poor): The number of toner particles caught on the adhesive surface is more than 100 per 1 $cm^2$.

(10) Fogging After Toner Supply

A white solid image corresponding to 6,000 A4-size sheets is formed to consume fogging toner. Subsequently, a developing apparatus is resupplied with new toner in an amount corresponding to 10% of residual toner by weight. There is observed a phenomenon in which fogging caused on the white solid image formed immediately after the developing apparatus is resupplied with the new toner temporarily increases. The fogging after toner supply is determined by performing the same procedure as that of normal fogging.

Lv 4 (Good): The OD value for fogging toner is 0.10 or less.

Lv 3 (Fair): The OD value for fogging toner is 0.15 or less and more than 0.10.

Lv 2 (Poor): The OD value for fogging toner is 0.20 or less and more than 0.15.

Lv 1 (Poor): The OD value for fogging toner is more than 0:20.

TABLE 8

| | Example 1 | Example 2 | Example 3 |
|---|---|---|---|
| (1) Flight behavior | Lv 4: Good | Lv 4: Good | Lv 4: Good |
| (2) Supply delay | Lv 4: Good | Lv 4: Good | Lv 4: Good |
| (3) Leakage during regulation | Lv 4: Good | Lv 4: Good | Lv 4: Good |
| (4) Scattering at upper seal | Lv 4: Good | Lv 4: Good | Lv 4: Good |
| (5) Developing gap scattering | Lv 4: Good | Lv 4: Good | Lv 4: Good |
| (6) Fogging | Lv 4: Good | Lv 4: Good | Lv 4: Good |
| (7) Leakage during regulation after toner supply | Lv 4: Good | Lv 4: Good | Lv 4: Good |
| (8) Scattering at upper seal after toner Supply | Lv 4: Good | Lv 4: Good | Lv 4: Good |
| (9) Developing gap scattering after toner supply | Lv 4: Good | Lv 4: Good | Lv 4: Good |
| (10) Fogging after toner supply | Lv 4: Good | Lv 4: Good | Lv 4: Good |

TABLE 9

| | Comparative Example 1 | Comparative Example 2 |
|---|---|---|
| (1) Flight behavior | Lv 3: Fair | Lv 4: Good |
| (2) Supply delay | Lv 4: Good | Lv 4: Good |
| (3) Leakage during regulation | Lv 4: Good | Lv 4: Good |
| (4) Scattering at upper seal | Lv 4: Good | Lv 4: Good |
| (5) Developing gap scattering | Lv 3: Fair | Lv 3: Fair |
| (6) Fogging | Lv 2: Poor | Lv 2: Poor |
| (7) Leakage during regulation after toner supply | Lv 4: Good | Lv 4: Good |
| (8) Scattering at upper seal after toner Supply | Lv 4: Good | Lv 4: Good |
| (9) Developing gap scattering after toner supply | Lv 2: Poor | Lv 3: Fair |
| (10) Fogging after toner supply | Lv 2: Poor | Lv 2: Poor |

As is clear from Tables 8 and 9, the toners of the invention cause less developing gap scattering and fogging. Furthermore, the toners cause less developing gap scattering and fogging even after toner supply.

The invention can provide a toner, a method for forming an image, and an image forming apparatus that produces less dust and causes less developing gap scattering and fogging and also causes less developing gap scattering and fogging after toner supply.

The entire disclosure of Japanese Patent Application No.2009-096735, filed Apr. 13, 2009 is expressly incorporated by reference herein.

What is claimed is:

1. A toner comprising: toner base particles containing at least a binder resin, a coloring agent, and a release agent, wherein the toner base particles have a volume-average particle size ($D_{50}$) of 2.0 to 12.0 μm and are obtained by phase inversion emulsification; and alumina fine particles whose phase angle (θ) is |80°| or less at an alternating current frequency of 1 to 10 kHz in an alternating current impedance method, wherein, an amount of the alumina fine particles added to 100 parts of tone base particles is 0.5 to 2.0 parts by mass, and wherein the alumina fine particles are obtained by vaporizing or by pyrolyzing ammonium dawsonite, wherein the binder resin is composed of a polyester resin, wherein the polyester resin has: a weight-average molecular weight of 30,000 or more; a ratio of weight-average molecular weight to number-average molecular weight is 12 or more; an area ratio of a component having a molecular weight of 600,000 to a total is 0.3% or more; and an area ratio of a component having a molecular weight of 10,000 or less to the total is 20 to 80%.

2. The toner according to claim 1, wherein the alumina fine particles have a BET specific surface area of 30 to 250 $m^2/g$ and a number-average particle size of 5 to 80 nm.

3. A method for forming an image comprising a toner comprising: preparing a photo-conductor that carries an electrostatic latent image and a developing apparatus facing the photo-conductor in a noncontact manner, the developing apparatus including a developing roller having a surface comprising the toner for developing the electrostatic latent image carried by the photo-conductor and a supplying roller configured to supply the toner to the developing roller; supplying the toner to the developing apparatus; and developing the electrostatic latent image carried by the photo-conductor under an alternating current electric field with an alternating current frequency of 1 to 10 kHz, the alternating current frequency of 1 to 10 kHz being set based on a gap between the photoconductor and the developing roller, wherein the toner includes toner base particles having have a volume-average particle size (Ds0) of 2.0 to 12.0 μm and containing at least a binder resin, a coloring agent, and a release agent and alumina fine particles whose phase angle (θ) is |80°| or less at an alternating current frequency of 1 to 10 kHz in an alternating current impedance method, wherein, an amount of alumina fine particles added to 100 parts of tone base particles is 0.5 to 2.0 parts by mass and wherein the alumina fine particles are obtained by vaporizing aluminum using direct current arc plasma and then oxidizing the vapor or by pyrolyzing ammonium dawsonite, and the surface of the developing roller has a spiral groove formed with a constant pitch in an axis direction so as to be inclined with respect to the axis direction and a circumferential direction, wherein the binder resin is composed of polyester resin, wherein the polyester resin has: a weight-average molecular weight of 30,000 or more; a ratio of weight-average molecular weight to number-average molecular weight is 12 or more; an area ratio of a component having a molecular weight of 600,000 to a total is 0.3% or more; and an area ratio of a component having a molecular weight of 10,000 or less to the total is 20 to 80%.

4. The method according to claim 3, wherein when the developing apparatus is a toner supply developing apparatus that can be resupplied with the toner, development is performed using a newly supplied toner in addition to a residual toner, and when the developing apparatus is a single-use toner-type developing apparatus that cannot be resupplied with the toner, development is performed using a newly loaded toner in addition to a residual toner.

5. The toner according to claim 1, wherein the hydrophilic alumina fine particles have a phase angle (θ) in a range of |40°| to |80°| at an alternating current frequency of 1 to 10 kHz in an alternating current impedance method.

6. The method according to claim 3, wherein the hydrophilic alumina fine particles have a phase angle (θ) in a range of |40°| to |80°| at an alternating current frequency of 1 to 10 kHz in an alternating current impedance method.

* * * * *